US007974552B2

(12) United States Patent
Imamura et al.

(10) Patent No.: US 7,974,552 B2
(45) Date of Patent: Jul. 5, 2011

(54) DEVICE AND METHOD FOR FORMING A NIP IN AN IMAGE FORMING APPARATUS

(75) Inventors: Atsushi Imamura, Matsumoto (JP); Yujiro Nomura, Shiojiri (JP); Yoshihisa Saka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/759,915

(22) Filed: Apr. 14, 2010

(65) Prior Publication Data

US 2010/0260512 A1 Oct. 14, 2010

(30) Foreign Application Priority Data

Apr. 14, 2009 (JP) ..... 2009-097977

(51) Int. Cl.
*G03G 15/08* (2006.01)

(52) U.S. Cl. ..... 399/121; 399/66; 399/154; 399/302; 399/313

(58) Field of Classification Search ..... 399/66, 399/121, 154, 302, 313
See application file for complete search history.

(56) References Cited

U.S. PATENT DOCUMENTS

| | | | | |
|---|---|---|---|---|
| 6,026,257 | A * | 2/2000 | Takami et al. | 399/66 |
| 7,376,375 | B2 * | 5/2008 | Kobayashi et al. | 399/301 |
| 2005/0201789 | A1 * | 9/2005 | Yuminamochi | 399/390 |
| 2010/0260522 | A1 * | 10/2010 | Imamura et al. | 399/313 |

FOREIGN PATENT DOCUMENTS

| | | | |
|---|---|---|---|
| JP | 2000-238400 | A | 9/2000 |
| JP | 2009-014808 | A | 1/2009 |

* cited by examiner

*Primary Examiner* — David P Porta
*Assistant Examiner* — Casey Bryant
(74) *Attorney, Agent, or Firm* — Maschoff Gilmore & Israelsen

(57) ABSTRACT

An image forming apparatus includes an image carrier which moves while carrying an image and a transfer roller including a roller base material which faces the image carrier and rotates. A concave portion is positioned on a peripheral surface of the roller base material. A grip unit on the concave portion grips a recording medium. An elastic layer is disposed on a peripheral surface of the roller base material. The transfer roller grips a recording medium by the grip unit when the concave portion faces the image carrier and passes the recording medium through a nip between the image carrier and the elastic layer when facing each other so that the image carried on the image carrier is transferred on the recording medium. A roller driving unit rotates the roller base material. A control unit controls the roller driving unit to adjust a timing for forming the nip.

7 Claims, 17 Drawing Sheets

4
42
43
422
422a
421
D4
IVA-2
IVA-2
IVB-2
IVB-2
31
341
342
34
A34
51
41
44
441
442
471
472
47
46
423
A32
32
NP

RELATIONSHIP BETWEEN OPERATION AND PHASE OF TRANSFER ROLLER

PHASE B: NIP RELEASE POSITION

PHASE A1, A2: NIP OPEN POSITION

AT HIGH SPEED ROTATION
(ω1=ω1b>ω1a)
tCb

AT REFERENCE (ω1=ω1a)
tCa

AT LOW SPEED ROTATION
(ω1=ω1b<ω1a)
tCc
NIP FORMING
TIMING tC
4
42
43
811
421
82
812
D4
44
41
NP
31
FP
32
51
RM
TI

TRANSPORT START OF RECORDING MEDIUM

START OF PAPER BITING OPERATION

COMPLETION OF PAPER BITING OPERATION

START OF SECONDARY TRANSFER PROCESS

IN SECONDARY TRANSFER PROCESS

RELEASE OF RECORDING MEDIUM

FIRST MODIFIED EXAMPLE

SECOND MODIFIED EXAMPLE

THIRD MODIFIED EXAMPLE

DEVICE AND METHOD FOR FORMING A NIP IN AN IMAGE FORMING APPARATUS

BACKGROUND

1. Technical Field

The present invention relates to an image forming apparatus and an image forming method using the apparatus which is provided with a transfer roller transferring an image formed on an image carrier to a recording medium.

2. Related Art

There is disclosed an image forming apparatus which develops an electrostatic latent image to be visible using a liquid developer with high viscosity in which a toner containing solid content is dispersed in a carrier liquid (for example, refer to JP-A-2009-14808, FIG. 1). In the image forming apparatus, four image forming stations are provided which form images with different colors from each other, and toner images formed by the respect image forming stations are overlapped on an intermediate transfer belt so as to form a color image. The intermediate transfer belt is suspended on a pair of driving roller and a driven roller which are disposed separately from each other, and drives a driving roller by using a belt driving motor so as to move in a predetermined direction while the color image is carried. In addition, a secondary transfer apparatus which is often used as a dry image forming apparatus is provided to face the driving roller, the color image is secondarily transferred onto a recording medium such as paper, film and cloth. In other words, in the secondary transfer position, a secondary transfer roller of which an external peripheral surface is covered by an elastic member such as rubber is disposed to face the driving roller with the intermediate transfer belt interposed therebetween, so that a nip is formed between the intermediate transfer belt and the elastic member. Then, by driving the driving roller by a belt driving motor, the intermediate transfer belt is rotated and the secondary transfer roller is rotatably driven with respect to the intermediate transfer belt, and the recording medium is nipped and transported through the nip. During nipping and transporting the recording medium, a color image on the intermediate transfer belt is secondarily transferred onto the recording medium.

In such an image forming apparatus, a position accuracy of an image with respect to the recording medium is required in order to increase the image quality, so that various studies have been carried out on each part of the apparatus. However, for example, as the apparatus disclosed in JP-A-2009-14808 (in FIG. 1), when the secondary transfer roller is rotatably driven so as to perform the secondary transfer on the intermediate transfer belt, a position of the image with respect to the recording medium cannot be adjusted in the secondary transfer position.

SUMMARY

An advantage of some aspects of the invention is to provide an image forming apparatus and an image forming method, which can adjust a position of an image with respect to a recording medium with high accuracy when the image on an image carrier is transferred onto the recording medium.

According to an aspect of the invention, there is provided an image forming apparatus which includes: an image carrier which moves at a predetermined speed while carrying an image; a transfer roller which includes a roller base material which faces the image carrier and rotates, a concave portion which is provided on a peripheral surface of the roller base material, a grip unit which is disposed on the concave portion and grips a recording medium, and an elastic layer which is disposed on a peripheral surface of the roller base material, the transfer roller which grips a recording medium by the grip unit when the concave portion faces the image carrier and passes the recording medium through a nip which is formed between the image carrier and the elastic layer when facing each other so that the image carried on the image carrier is transferred on the recording medium; a roller driving unit which rotates the roller base material; and a control unit which controls the roller driving unit so as to adjust a timing for forming the nip.

In addition, according to another aspect of the invention, there is provided an image forming method comprising the steps of: rotating a roller base material while facing an image carrier which moves at a predetermined speed while carrying an image; gripping a recording medium by a grip unit which is disposed on a concave portion while the concave portion provided on a peripheral surface of the roller base material faces the image carrier; transferring the image carried on the image carrier onto the recording medium by passing the recording medium through a nip while an elastic layer disposed on a peripheral surface of the roller base material contacts with the image carrier so as to form the nip between the image carrier and the elastic layer; and adjusting a timing for forming the nip.

In the invention (imaging forming apparatus and image forming method) as configured above, when the concave portion faces the image carrier, the recording medium is gripped by the grip unit provided at the concave portion, and then the elastic layer contacts with the image carrier so as to form the nip between the image carrier and the elastic layer, and the recording medium passes through the nip so that the image on the image carrier is transferred onto the recording medium. In the invention, timing for forming the nip is adjusted, and the image on the image carrier is transferred on a position corresponding to the nip forming timing in the recording medium. Therefore, by adjusting the nip forming timing, a position of the image with respect to the recording medium can be adjusted with high accuracy. Here, in order to adjust the nip forming timing, for example, a rotation speed of the roller base material when the concave portion faces the image carrier may be controlled. In particular, the nip forming timing is preferably adjusted such that after the recording medium is gripped by the grip unit, the rotation speed of the roller base material is changed.

In addition, in the invention as configured above, an operational advantage is obtained in which so-called paper jamming can be prevented. In other words, as in the apparatus described in JP-A-2009-14808 (in FIG. 1), when the secondary transfer roller is rotatably driven with respect to the image carrier, the recording medium cannot be separated from the image carrier on the outlet side of the nip, and the recording medium is attached to the image carrier. In particular, in a wet image forming apparatus using a liquid developer, the above-mentioned problems are serious. In contrast, in the invention, since the recording medium is gripped by the grip unit of the transfer roller, the transferred recording medium is not attached to the image carrier, but is definitely separated from the image carrier on the output side of the nip so as to be conveyed. For this reason, paper jamming is effectively prevented.

BRIEF DESCRIPTION OF THE DRAWINGS

The invention will be described with reference to the accompanying drawings, wherein like numbers reference like elements.

FIGS. 4A-1 to 4B-2 are diagrams illustrating a relationship among a secondary transfer roller, an intermediate transfer belt and a driving roller.

DESCRIPTION OF EXEMPLARY EMBODIMENTS

Figure 1:
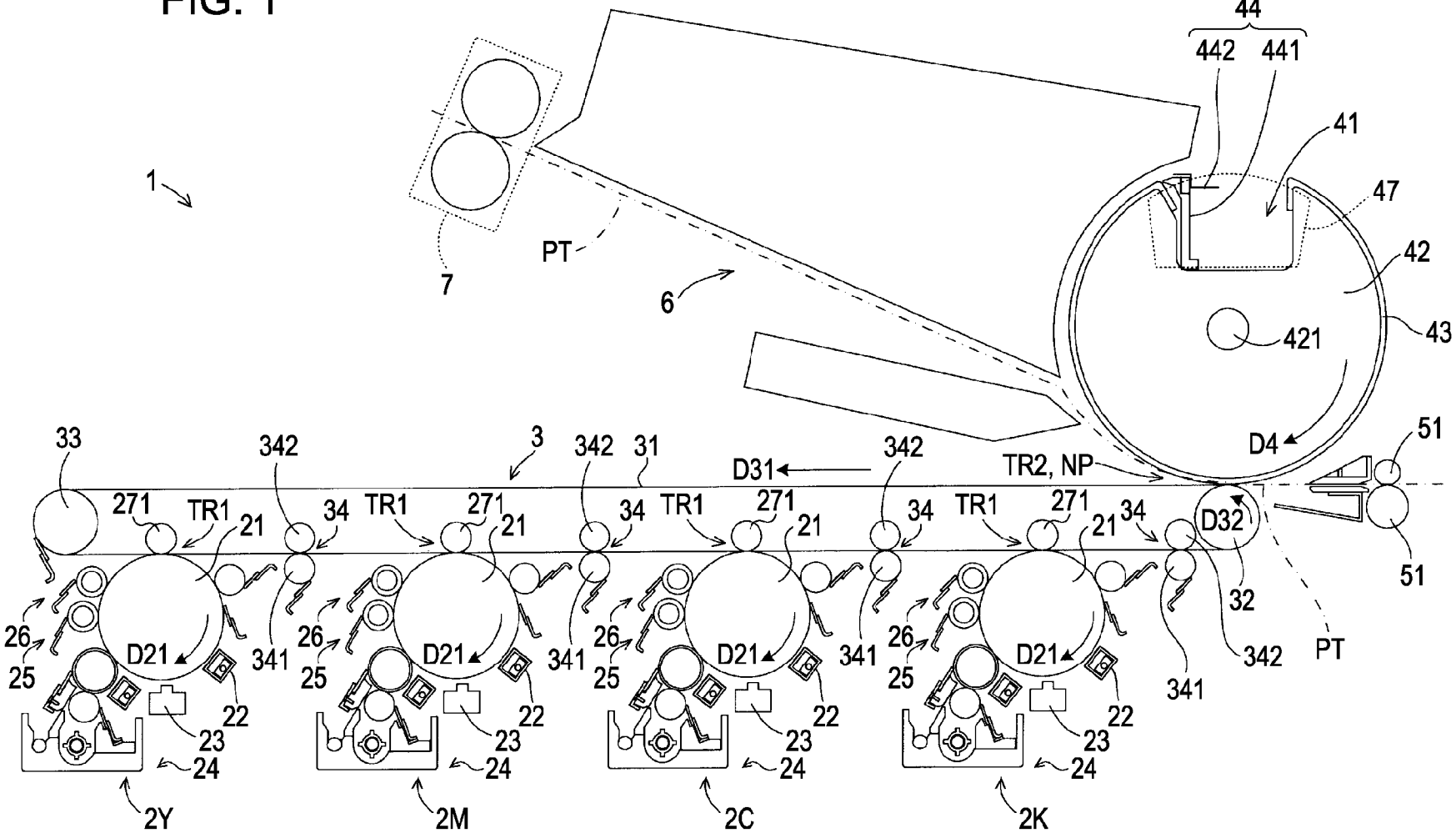
FIG. 1 is a diagram illustrating an image forming apparatus according to a first embodiment of the invention.
Figure 2:
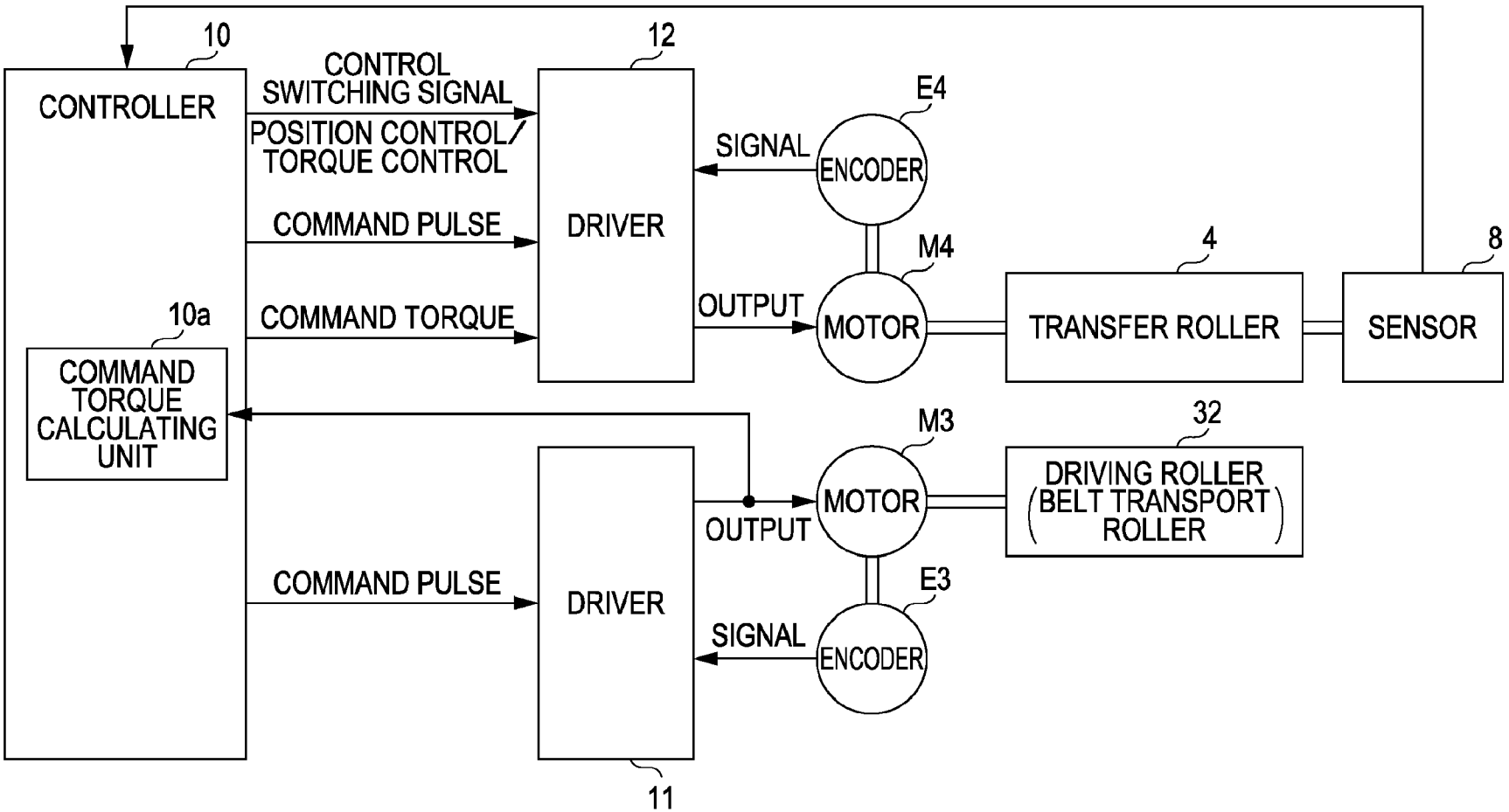
FIG. 2 is a block diagram illustrating the electric configuration of the apparatus shown in FIG. 1.

FIG. 1 is a diagram illustrating an image forming apparatus according to a first embodiment of the invention. In addition, FIG. 2 is a block diagram illustrating an electric configuration of the apparatus shown in FIG. 1. The image forming apparatus 1 is provided with four image forming stations 2Y (yellow), 2M (magenta), 2C (cyan) and 2K (black) for forming different color images different from each other. The image forming apparatus 1 is configured to be able to selectively perform a color mode in which four colors of toner, yellow (Y), magenta (M), cyan (C) and black (K), are mixed to form a color image, and in a monochrome mode in which only black (K) toner is used to form a monochrome image. In the image forming apparatus, when an external apparatus such as a host computer gives an image forming command pulse to a controller 10 having a CPU or a memory or the like, the controller 10 controls each part of the apparatus so as to perform a predetermined image forming operation, and forms an image corresponding to the image forming command on a sheet-shaped recording medium RM such as copy paper, transfer paper, paper and a transparent sheet for OHP. As described above, in this embodiment, the controller 10 corresponds to a "control unit" according to the invention.

In each of the image forming stations 2Y, 2M, 2C and 2K, a photosensitive drum 21 is provided to form each color of toner image on a surface thereof. Each photosensitive drum 21 is disposed such that the rotation shaft thereof is parallel or substantially parallel to a main scanning direction (vertical direction with respect to the paper of FIG. 1), and is rotatably driven at a predetermined speed in the direction of arrow D21 in FIG. 1.

In the vicinity of each photosensitive drum 21, a charger 22 which is a corona charger for charging the surface of the photosensitive drum 21 with a predetermined potential, an exposure unit 23 which forms an electrostatic latent image by exposing the surface of the photosensitive drum 21 according to an image signal, a developing unit 24 which develops the electrostatic latent image as a toner image, a first squeeze unit 25, a second squeeze unit 26, a primary transfer unit which primarily transfers the toner image onto an intermediate transfer belt 31 of the transfer unit 3, a cleaning unit which cleans the surface of the photosensitive drum 21 after transferring, and a cleaner blade are disposed along the rotation direction D21 (clockwise direction in FIG. 1) of the photosensitive drum 21 in the order described above.

The charger 22 does not come into contact with the surface of the photosensitive drum 21, and as for the charger 22, the well-known corona charger according to the related art may be used. When a scorotron charger is used as the corona charger, negative wire current flows in a charge wire of the scorotron charger and a grid charge bias of direct current (DC) is applied to a grid. The photosensitive drum 21 is charged by corona discharge of the charger 22, so that the potential of the surface of the photosensitive drum 21 is set to a uniform potential.

The exposure unit 23 exposes the surface of the photosensitive drum 21 to light beam according to an image signal given from an external apparatus so as to form an electrostatic latent image corresponding to the image signal. As for the exposure unit 23, it can be configured by one which scans light beam from a semiconductor laser using a polygon mirror, or by a line head in which light-emitting elements are disposed in a main scanning direction.

Toners are supplied from the developing unit 24 on the electrostatic latent image formed as described above, so that the electrostatic latent image is developed by the toners. In the developing unit 24 of the image forming apparatus 1, the toners are developed by using a liquid developer in which toners are dispersed in a carrier liquid in an amount of about 20%. In this embodiment, instead of a volatile liquid developer with low concentration (1 to 2 wt %) and low viscosity which volatilizes at room temperature and has a carrier liquid as Isopar (Registered Trademark: EXXON), a liquid developer is used, in which a high-concentrated and high-viscosity solid content with an average particle diameter of 1 μm made by dispersing a colorant such as a pigment into a nonvolatile resin at room temperature is added as a dispersion agent into a liquid solvent such as an organic solvent, a silicon oil, a mineral oil or an edible oil, and which has high viscosity (about 30 to 10000 mPa·s) of which the concentration of toner solid content is about 20%.

On the downstream side of a develop position in the rotation direction D21 of the photosensitive drum 21, the first squeeze unit 25 is disposed, and a second squeeze unit 26 is disposed on the downstream side of the first squeeze unit 25. Each of these squeeze units 25 and 26 is provided with a squeeze roller. Then, each squeeze roller comes into contact with the surface of the photosensitive drum 21 so as to remove a surplus carrier liquid or fog toners. Further, in this embodiment, the surplus carrier liquid or the fog toners is removed by two squeeze units 25 and 26, but the number or the arrangement of the squeeze units is not limited. For example, one squeeze unit may be disposed.

A toner image passing through the squeeze units 25 and 26 is primarily transferred onto the intermediate transfer belt 31 by the primary transfer unit. The intermediate transfer belt 31 is suspended on a pair of belt transport rollers 32 and 33 which are separately disposed from each other so as to peripherally rotate in a predetermined direction D31 by the rotation of the belt driving motor M3. More specifically, the roller 32 on the left side in FIG. 1 among these belt transport rollers 32 and 33 comes to be a driving roller, and the belt driving motor M3 is mechanically connected to the driving roller 32. In addition, in this embodiment, a driver 11 is provided to drive the belt driving motor M3, and outputs a driving signal according to a command pulse given from the controller 10 to the belt driving motor M3 so as to be subjected to the position control. Therefore, the driving roller (belt transport roller) 32 rotates in the direction of arrow D32 in FIG. 1 at a peripheral speed corresponding to the command pulse, and the surface of the intermediate transfer belt 31 moves peripherally in the direction D31 at a predetermined speed. Further, Reference numeral E3 in the drawing denotes an encoder which is attached to the belt driving motor M3, and supplies a signal corresponding to the rotation of the belt driving motor M3 to the driver 11. The driver 11 received the signal carries out a feedback control on the belt driving motor M3 on the basis of the signal. In this embodiment, the intermediate transfer belt 31 configured as described above corresponds to the "image carrier" according to the invention.

The primary transfer unit has a backup roller 271. The backup roller 271 is disposed at a primary transfer position TR1 so as to contact the photosensitive drum 21 with the intermediate transfer belt 31 interposed therebetween, and transfers a toner image on the photosensitive drum 21 onto the intermediate transfer belt 31. By performing transfer of the toner image by each color of transfer units 27, each color of the toner images on the photosensitive drum 21 is sequentially overlapped onto the intermediate transfer belt 31 so as to form a full color of the toner image.

In this embodiment, in order to remove surplus carrier liquid from the toner image transferred on the intermediate transfer belt 31, a belt squeeze unit 34 is disposed on the downstream side of the primary transfer position TR1 for each color. In the belt squeeze unit 34, an intermediate transfer squeeze roller 341 is disposed on a carrier surface side of the toner image of the intermediate transfer belt 31, and a backup roller 342 is disposed to face the intermediate transfer squeeze roller 341 with the intermediate transfer belt 31 interposed therebetween. By the intermediate transfer squeeze roller 341, the surplus carrier liquid is removed from the toner image on the intermediate transfer belt 31.

The toner image transferred on the intermediate transfer belt 31 as described above is transported to a secondary transfer position TR2 as shown in FIG. 1. At the secondary transfer position TR2, the secondary transfer roller 4 is disposed to face the driving roller 32 of the transfer unit 3 with the intermediate transfer belt 31 interposed therebetween, and the intermediate transfer belt 31 is wound around the driving roller 32. At the secondary transfer position TR2, a monochrome color or plural colors of toner image formed on the intermediate transfer belt 31 is transferred onto the recording medium RM which is transported along a transport path PT from a pair of gate rollers 51 and 51. Further, in this embodiment, since the toner image is formed in a wet developing method of forming a toner image using a liquid developer, the secondary transfer roller 4 having a grip unit is used which is described later.

The recording medium RM on which the toner image is secondarily transferred is sent to a transport mechanism 6 along the transport path PT from the secondary transfer roller 4. In addition, on the downstream side of the transport path PT, that is, an opposite side (left side of FIG. 1) of the secondary transfer roller 4 with respect to the transport mechanism 6, a fixing unit 7 is disposed to apply heat or pressure on a monochrome color or plural colors of the toner image which is transferred on the recording medium RM so as to fix the toner image onto the recording medium RM.

Figure 3A:
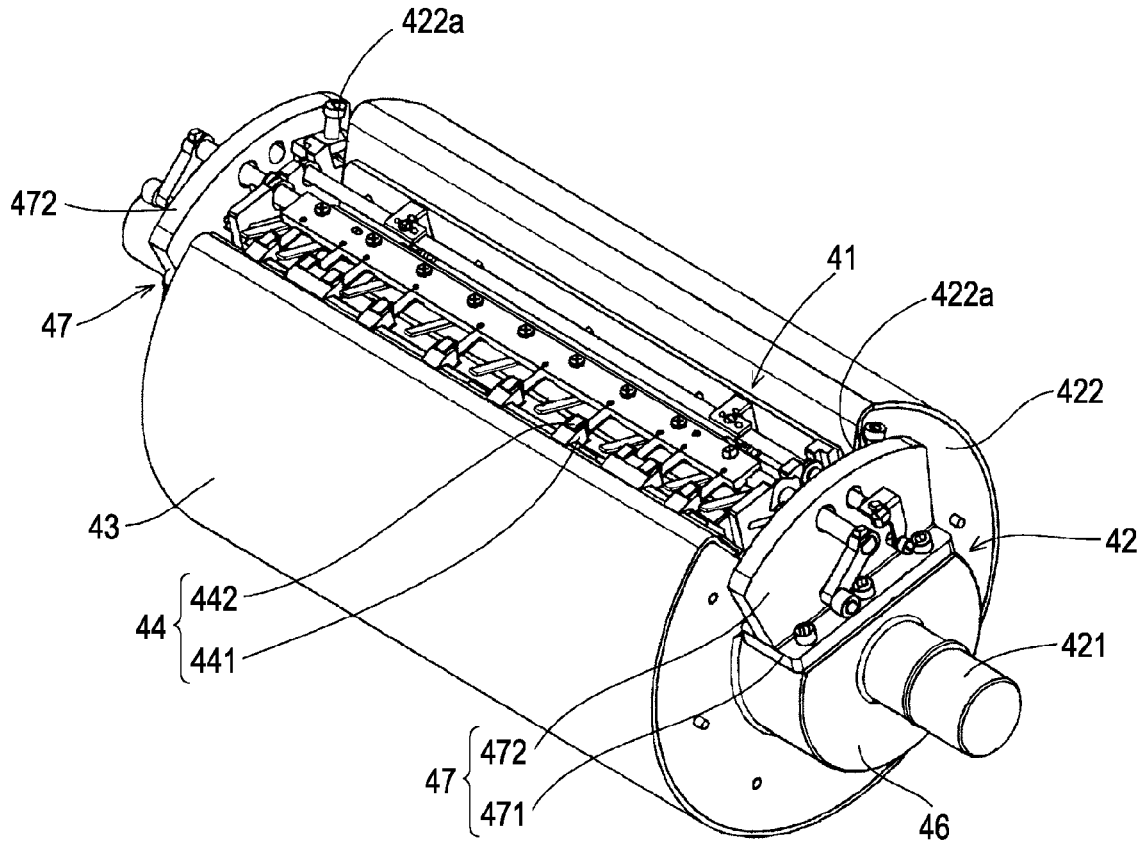
FIGS. 3A and 3B are diagrams illustrating a secondary transfer roller which is used by the image forming apparatus shown in FIG. 1.
Figure 3B:
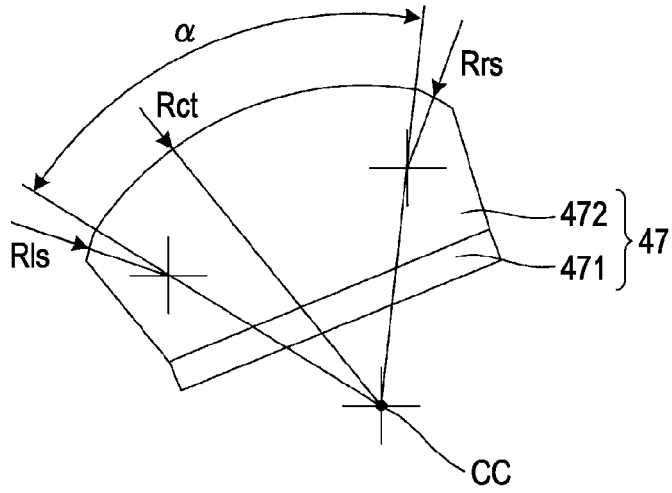
Figures 1, 2, 4A, 4B:
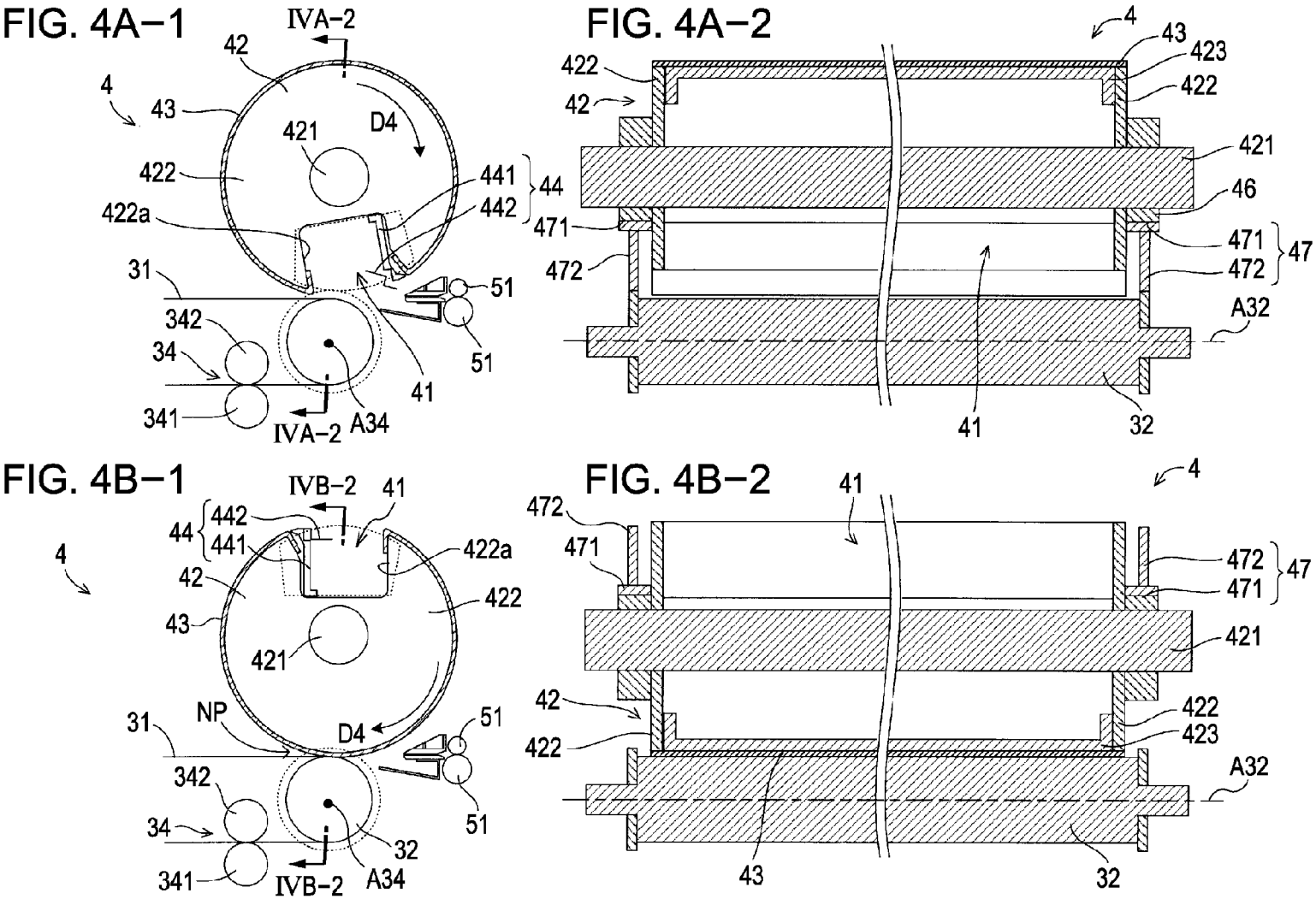

FIGS. 3A and 3B are diagrams illustrating the secondary transfer roller which is used in the image forming apparatus shown in FIG. 1. FIG. 3A is a perspective view illustrating the entire configuration of the secondary transfer roller, and FIG. 3B is a side view illustrating the shape of a contact member. In addition, FIGS. 4A-1, 4A-2, 4B-1 and 4B-2 are diagrams illustrating a relationship among the secondary transfer roller, the intermediate transfer belt and the driving roller. FIG. 4A-1 is a side view illustrating a concave portion facing the driving roller, FIG. 4A-2 is a cross-sectional view taken along the line IVAII-IVAII in FIG. 4A-1, FIG. 4B-1 is a side view illustrating a formed nip, and FIG. 4B-2 is a cross-sectional view taken along the line IVBII-IVBII of FIG. 4B-1. As shown in these drawings, the secondary transfer roller 4 includes a roller base material 42 in which the concave portion 41 is provided on the peripheral surface. As shown in FIGS. 4A-1 to 4B-2, in the roller base material 42, a rotation shaft 421 is disposed to be parallel or substantially parallel to a rotation shaft A32 (see FIGS. 4A-1 to 4B-2) of the driving roller (belt transport roller) 32, and side plates 422 and 422 are respectively attached to both ends of the rotation shaft 421. More specifically, all of these side plates 422 and 422 are in a shape in which a notched portion 422*a* with respect to a disk-shaped metal plate. The notched portion 422*a* is in a substantially-rectangular shape in a side view shown in FIGS. 4A-1 and 4B-1. As shown in FIGS. 3A and 3B, the notched portions 422*a* and 422*a* is separated by a distance slightly longer than the width of intermediate transfer belt 31 while facing each other so as to be attached to the rotation shaft 421. In addition, a metal plate 423 is disposed over the peripherals of both side plates 422 and 422, and the peripheral portion of the metal plate 423 is bonded to the inner surface of both side plates 422 and 422. As described above, the secondary roller is in a drum shape as a whole, and in a part of the outer peripheral surface, a roller base material 42 is formed which includes the concave portion 41 extending parallel or substantially parallel to the rotation shaft 421.

In addition, an elastic layer 43 such as rubber or resin is formed on the outer peripheral surface of the roller base material 42, that is, the surface region excepting the region corresponding to the inside of the concave portion 41 in the metal plate surface. The elastic layer 43 faces the intermediate transfer belt 31 which is wound around the driving roller 32 so as to form a nip NP as described later.

In addition, a grip unit 44 is disposed to grip the recording medium RM inside the concave portion 41. The grip unit 44 includes a gripper support base material 441 which is erected on the outer peripheral surface of the roller base material 42 from the inner bottom of the concave portion 41 and a gripper member 442 which is separably supported with respect to the tip end of the gripper support member 441. In addition, the gripper member 442 is connected to a gripper driving unit (not shown). Then, while receiving a command to stop gripping from the controller 10, the gripper driving unit operates to separate the tip end of the gripper member 442 from the tip end of the gripper support member 441 so as to perform grip preparation or grip release of the recording medium RM.

Further, the configuration of the grip unit 44 is not limited to this embodiment, but the gripping mechanism known from the related art, for example, JP-A-2000-238400 and the like, may be employed.

In both ends of the rotation shaft 421, support members 46 and 46 are attached on the outer surface of each side plate 422 so as to be able to integrally rotate with the roller base material 42. In addition, in each of the support members 46 and 46, a plane region 461 is formed to correspond to the concave portion 41. Then, a butting member 47 on the side of the transfer roller is attached to each of the plane regions 461 and 461. In the butting member 47, a base portion 471 is attached to the support member 46, and a butting portion 472 is extended from the base portion 471 in a normal direction of the plane region 461. The tip end of the butting portion 472 is extended up to the vicinity of the end of the opening of the concave portion 41. That is, as shown in FIG. 3A, when the roller base material 42 is viewed from the end of the rotation shaft 421, the butting member 47 is disposed to close the concave portion 41.

As shown in FIG. 3B, the tip end of the butting portion 472 is bent such that a curvature Rct of the center thereof is larger than curvatures Rrs and Rls of both ends. For example, in this embodiment, a roller external diameter of the roller base material 42 including the elastic layer 43 is set to about 191 mm, the curvature Rct thereof is set to 88.2 mm, the curvatures Rrs and Rls of both ends are set to 22.4 mm together. Further, the center CC of curvature in the center of butting portion 472 is disposed on the rotation shaft of the roller base material 42, that is, the center shaft of the rotation shaft 421. In addition, an angle range $\alpha$ of the center is set to 63° in correspondence with an open range of the concave portion 41. For this reason, when the secondary transfer roller 4 is rotated as described later, the concave portion 41 faces the intermediate transfer belt 31 wound around the driving roller 32 over the angle range $\alpha$. In addition, an opening length of the concave portion 41 along the rotation direction D4 of the roller base material 42 is $191\times\pi\times(63/360)\cong105$ mm. On the other hand, as described in the followings, the elastic layer 43 faces the intermediate transfer belt 31 in the other angle range so as to form the nip NP, the length of the elastic layer 43 along the rotation direction D4 of the roller base material 42 is set to $191\times\pi\times\{(360-63)/360\}\cong495$ mm.

In the secondary transfer roller 4 as configured above, the rotation shaft 421 is disposed to be parallel or substantially parallel to the rotation shaft A32 of the driving roller 32, and urged toward the driving roller 32 by an urging unit (not shown). For this reason, in the angle range (297° angle range) other than the angle range $\alpha$, as shown in FIGS. 4B-1 and 4B-2, the elastic layer 43 is pressed on the intermediate transfer belt 31 wound around the driving roller 32 so as to form the nip NP. In addition, in this embodiment, an annular-shaped butting member 322 is attached to both ends of the rotation shaft 321 of the driving roller 32, and the external diameter is set to be larger than the value of {(Thickness of Intermediate transfer belt 31)×2+(External diameter of Driving roller 32)}. For this reason, in the angle range $\alpha$, as shown in FIGS. 4A-1 and 4A-2, the center of the butting portion 472 on the transfer roller side comes into contact with the butting member 322 on the driving roller side, and the roller base material 42 and the elastic layer 43 become in a state of being separated from the intermediate transfer belt 31. In this embodiment as described above, the butting portion 472 on the transfer roller side comes into contact with the driving roller 32 via the butting member 322 on the driving roller, but the butting portion 472 on the transfer roller side may be configured to directly come into contact with the driving roller 32.

The transfer roller driving motor M4 is mechanically connected to the rotation shaft 421 of the secondary transfer roller 4. In addition, in this embodiment, a driver 12 is provided to drive the transfer roller driving motor M4. The driver 12 drives the motor M4 according to the command given from the controller 10, so that the secondary transfer roller 4 is rotatably driven in the clockwise direction in the paper of FIG. 1 so as to rotate in a width direction D4 with respect to the driving roller 32. As described above, in this embodiment, the secondary transfer roller 4 corresponds to the "transfer roller" according to the invention, and the driver 12 and the transfer roller driving motor M4 function as the "roller driving unit" according to the invention.

In this embodiment, an AC servo motor is used as the motor M4, and the AC servo motor is configured to be subjected to the position control or the torque control by the driver 12. That is, the driver 12 includes a position control circuit and a torque control circuit, and can selectively perform the position control and the torque control. The controller 10 can input a command pulse relating to position information, a command torque relating to torque information and a control switching signal to the driver 12. Then, the controller 10 inputs a command pulse to the driver 12 so as to switch the driving control mode of the driver 12 to perform the position control by the control switching signal, so that the driver 12 outputs a driving signal according to the command pulse to the transfer roller driving motor M4 to perform the position control so as to be able to position the secondary transfer roller 4 with accuracy. On the other hand, the controller 10 inputs a command torque to the driver 12 so as to switch the driving control mode of the driver 12 to perform the torque control by the control switching signal, so that the driver 12 outputs a driving signal according to the command torque to the transfer roller driving motor M4 to perform the torque control so as to be able to rotatably drive the secondary transfer roller 4 with torque corresponding to the command torque. In this embodiment, in order to control the change in load applied on the intermediate transfer belt 31 so as to stabilize the peripheral speed of the intermediate transfer belt 31, the command torque calculating unit 10*a* is provided at the controller 10, and the command torque determined by the command torque calculating unit 10*a* is output from the controller 10 so as to be input to the driver 12. The details of the above operation will be described later. Further, Symbol E4 in the drawing is an encoder which is attached to the transfer roller driving motor M4, and a signal corresponding to the rotation of the transfer roller driving motor M4 is given to the driver 12. Then, the driver 12 received the signal carries out a feedback control on the motor M4 on the basis of the signal.

Next, before describing the entire operation of the image forming apparatus as configured above, the operation of the secondary transfer roller 4 will be described with reference to FIG. 5.

Figure 5A:
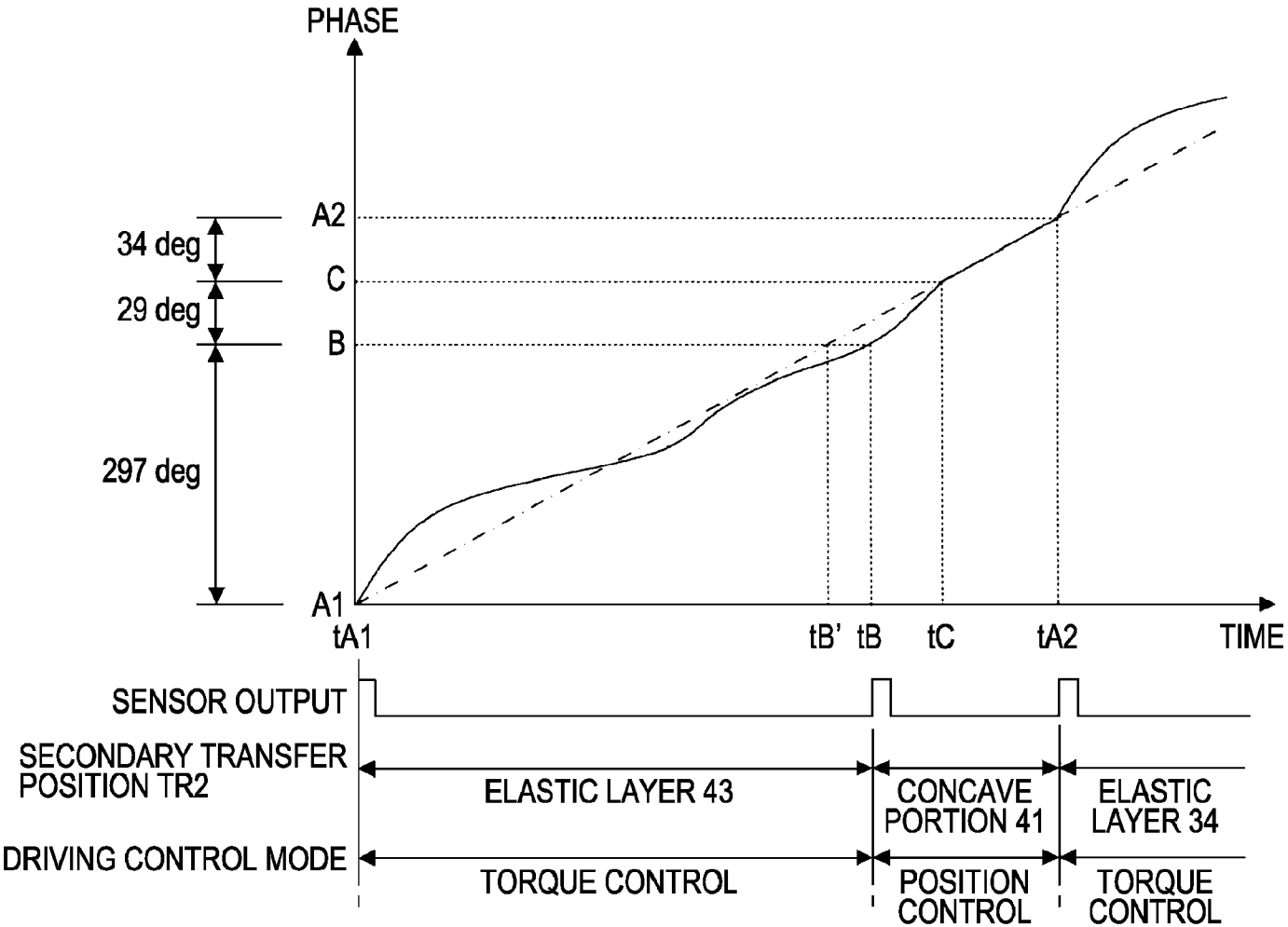
FIGS. 5A to 5C are diagrams illustrating an operation of a secondary transfer roller.
Figure 5B:
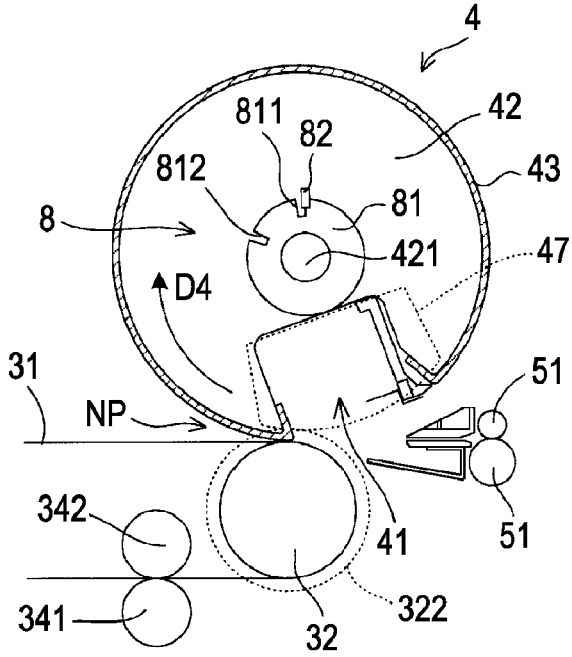
Figure 5C:
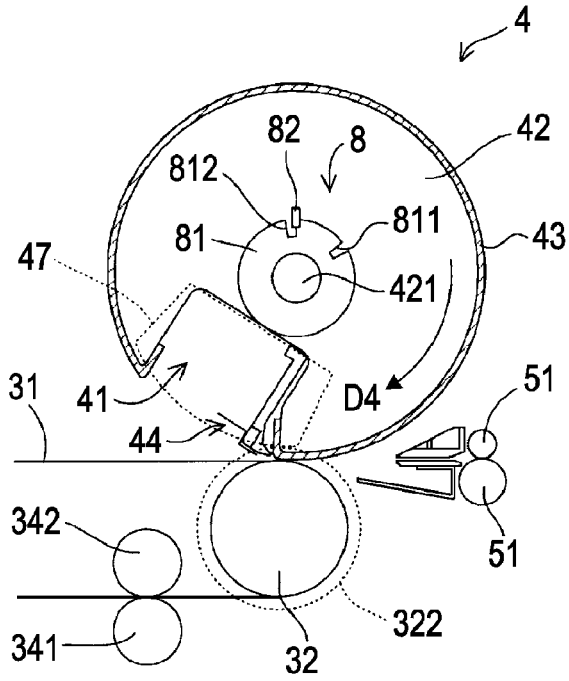

FIGS. 5A to 5C are diagrams illustrating the operation of the secondary transfer roller. FIG. 5A is a graph illustrating a relationship between the operation and the phase of the secondary transfer roller 4. FIG. 5B is a diagram schematically illustrating a positional relationship between the concave portion 41 of the secondary transfer roller 4 and the intermediate transfer belt 31 at the phase B in FIG. 5A. FIG. 5C is a diagram schematically illustrating a positional relationship between the concave portion 41 of the secondary transfer roller 4 and the intermediate transfer belt 31 at the phases A1 and A2 in FIG. 5A. Symbol 8 in the drawing is a phase detecting sensor which is connected to one end of the rotation shaft 421 of the secondary transfer roller 4. In the sensor 8, a disk-shaped slit plate 81 is connected to the rotation shaft 421 so as to rotate with the rotation shaft 421. In addition, in the slit plate 81, slits 811 and 812 are formed in two places. Among two slits, the slit 811 is used to detect a nip release position, that is, a position at which the elastic layer 43 is separated from the intermediate transfer belt 31, and the slit 812 is used to detect a nip start position, that is, a position at which the elastic layer 43 starts to come into contact with the intermediate transfer belt 31. In addition, in the phase detecting sensor 8, a sensor element 82 is fixedly disposed in order to detect these slits 811 and 812. Whenever the slits 811 and 812 are positioned in the detection range of the sensor element 82, a signal level output from the sensor element 82 to the controller 10 is changed from the L level to the H level, so that the nip release position and the nip start position can be detected. Further, in FIG. 5, the phases A1 and A2 of the secondary transfer roller 4 at the detection timings tA1 and tA2 at which the nip start position is detected by the sensor 8 is called "phase A", and the phase of the secondary transfer roller 4 at the detection timing tB at which the nip release position is detected by the sensor 8 is called "phase B". Further, a chain line in FIG. 5A is a phase curve when the secondary transfer roller 4 is rotated at a constant peripheral speed.

When the phase A (nip start position: FIG. 5C) is detected at timing tA1 by the sensor 8, the controller 10 issues the control switching signal so as to prompt the driver 12 to switch the driving control mode to the torque control and gives the command torque to the driver 12. Further, in this embodiment, the command torque is determined on the basis of the calculated result by the command torque calculating unit 10*a* of the controller 10. That is, the driver 11 outputs a signal to the belt driving motor M3 in order to rotate the driving roller 32, and at the same time the output signal is given to the command torque calculating unit 10*a* as shown in FIG. 2. The signal reflects the operation of the belt driving motor M3 and the driving state of the intermediate transfer belt 31, and a load state in which the intermediate transfer belt 31 is placed is obtained by analyzing the signal. However, by monitoring the signal, the change in the load applied on the intermediate transfer belt 31 can be detected. Therefore, in this embodiment, the signal given to the belt driving motor M3 from the driver 11 is output also to the command torque calculating unit 10*a*, and the command torque calculating unit 10*a* calculates the command torque corresponding to the load state applied on the intermediate transfer belt 31. As a result, the command torque is changed to be set according to the change in the load applied on the intermediate transfer belt 31, and the command torque is given to the driver 12 in order to always suppress the change in the load applied on the intermediate transfer belt 31.

The driver 12 received these signals outputs a driving signal according to the command torque to the transfer roller driving motor M4 so as to control the torque. Thereafter, when the secondary transfer roller 4 rotates in the rotation direction D4 so that the concave portion 41 is close to the surface of the intermediate transfer belt 31 and the phase B (nip release position: FIG. 5B) is detected by the sensor 8, the controller 10 issues the control switching signal so as to prompt the driver 12 to switch the driving control mode from the torque control to the position control and gives the command pulse to the driver 12 (timing tB). As described above, in this embodiment, the elastic layer 43 comes into contact with the intermediate transfer belt 31 at the nip start position so as to form the nip NP. Since the nip forming state continues until the secondary transfer roller 4 reaches the nip release position, during this period of time (timing tA1 to tB) the torque control is carried out on the secondary transfer roller 4 while rotating in a state where the elastic layer 43 comes into contact with the intermediate transfer belt 31. Therefore, while the secondary transfer roller 4 is coming into contact with the intermediate transfer belt 31, the load from the secondary transfer roller 4 to the intermediate transfer belt 31 is not largely changed, but the surface of the intermediate transfer belt 31 is stabilized, so that the secondary transfer roller 4 can be rotated at a constant peripheral speed. In addition, the recording medium RM is passed through the nip NP, so that a toner image on the intermediate transfer belt 31 is secondarily transferred onto the recording medium RM. Further, in this embodiment, in order to prevent the recording medium RM from sticking to the surface of the intermediate transfer belt 31, the recording medium RM which is transported from the gate rollers 51 and 51 is gripped at a proper timing tC (a timing at which the secondary transfer roller 4 rotates by 29° from the nip release position) by the grip unit 44 before the recording medium RM is sent into the nip NP as described above. More specifically, the secondary transfer roller 4 is controlled in its position as described in the following.

In this embodiment, a rotation speed ω0 (deg/sec) of the secondary transfer roller 4 (roller base material 42) at a timing tB, in which the phase B is detected by the sensor 8, that is, the nip release position is detected, is changed by the equation, $\omega 0=29/(tC-tB)$. Therefore, the grip unit 44 at the timing tC is located on a position (recording medium gripping position (see FIG. 8B)) in which the recording medium RM transported from the gate rollers 51 and 51 can be gripped. Further, before the secondary transfer roller 4 reaches the recording medium gripping position, the controller 10 operates the gripper driving unit at a proper timing so as to separate the tip end of the gripper member 442 from the tip end of the gripper support member 441, and the grip preparation of the recording medium RM is completed. Therefore, the recording medium RM can be securely gripped at the recording medium gripping position.

In addition, when reaching the timing tC, the rotation speed ω1 (deg/sec) of the secondary transfer roller 4 is changed by the equation, $\omega 1=34/(tA2-tC)$. In this embodiment, the rotation speed ω1 is not a fixed value, but the controller 10 can adjust the rotation speed ω1 by changing the command pulse to be given to the driver 12. For this reason, by controlling the rotation speed ω1, a start timing of the elastic layer 43 with respect to the intermediate transfer belt 31, that is, a timing at which the nip is formed can be adjusted. Here, the description will be made by exemplifying: (a) a time when the secondary transfer roller 4 is controlled such that the peripheral speed of the secondary transfer roller 4 is matched with the moving speed of the surface of the intermediate transfer belt 31; (b) a time when the secondary transfer roller 4 is controlled such that the peripheral speed of the secondary transfer roller 4 is faster than the moving speed of the surface of the intermediate transfer belt 31; and (c) a time when the secondary transfer roller 4 is controlled such that the peripheral speed of the secondary transfer roller 4 is slower than the moving speed of the surface of the intermediate transfer belt 31.

Figures 6A, 6B, 6C:
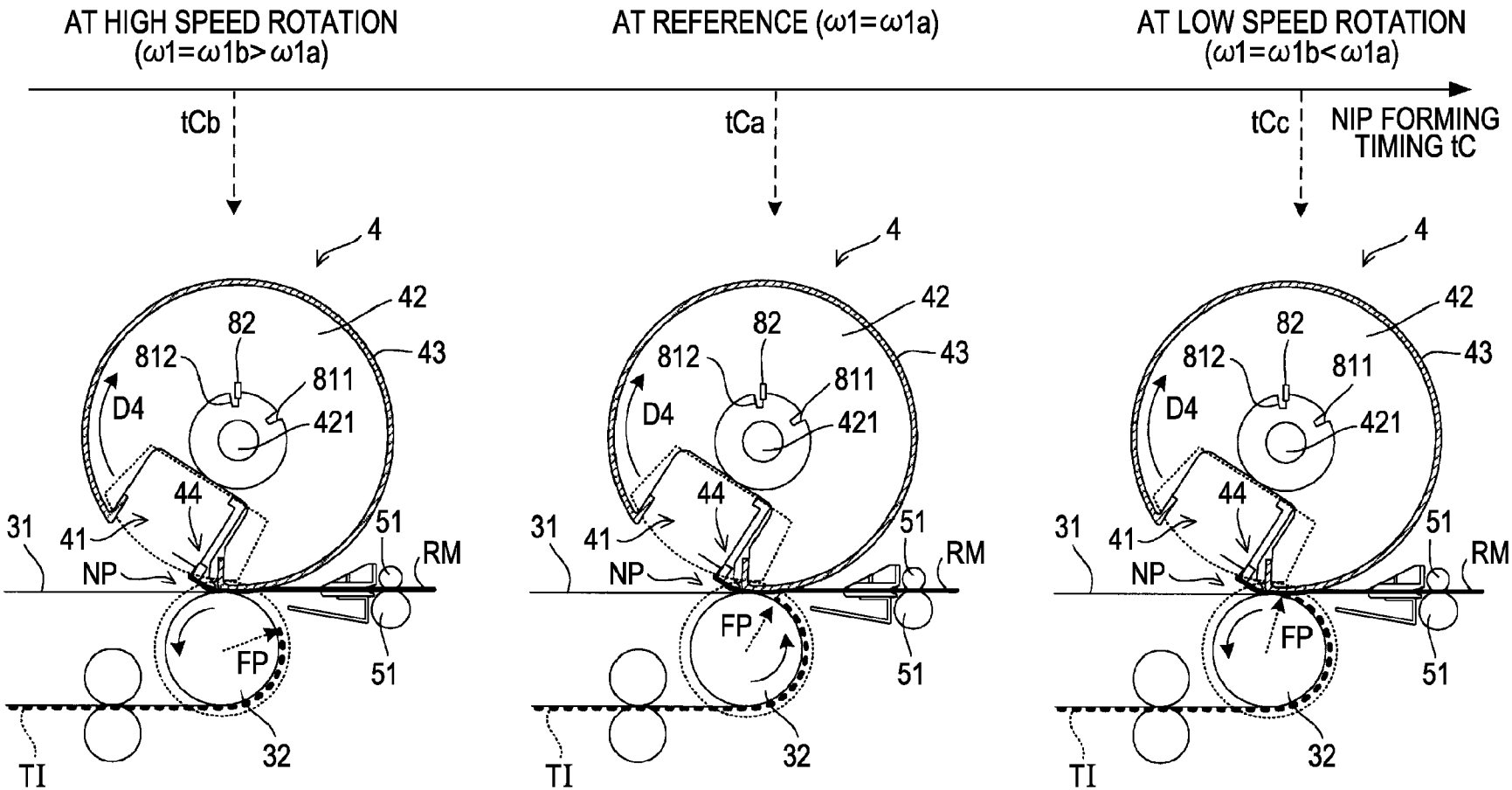
FIGS. 6A to 6C are diagrams schematically illustrating a relationship between a nip forming timing and a transfer position of a toner image.

FIGS. 6A to 6C are diagrams schematically illustrating a relationship between a nip forming timing and a transfer position of a toner image. FIG. 6A shows an operation state in the above condition (a). FIG. 6B shows an operation state in the above condition (b). FIG. 6C shows an operation state in the above condition (c). Here, the description will be made assuming that when the secondary transfer roller 4 is controlled such that the peripheral speed of the secondary transfer roller 4 is matched with the moving speed of the surface of the intermediate transfer belt 31, the rotation speed of the secondary transfer roller 4 is the reference rotation speed ω1*a*, and the timing when the elastic layer 43 starts to face the intermediate transfer belt 31 is the timing tCa. In this embodiment, by changing a command pulse, the rotation speed of the secondary transfer roller 4 is adjusted and the timing (nip forming timing) tC can be changed as the following.

For example, as being apparent in contrast to FIGS. 6A and 6B from each other, when the rotation speed of the secondary transfer roller 4 is higher than the reference rotation speed ω1*a*, the transport speed of the recording medium RM is higher than the moving speed of the surface of the intermediate transfer belt 31. In this case, the nip forming timing tCb is earlier than the timing tCa, and the tip end position FP of the toner image TI is located on a position separated from the nip NP by the difference (=tCa−tCb). For this reason, in a high speed rotation, the toner image on the intermediate transfer belt 31 slowly reaches the nip NP compared with the reference time (a time to rotate the secondary transfer roller 4 at the reference rotation speed ω1*a*). As a result, a distance between the toner image TI transferred on the recording medium RM and the tip end of the recording medium RM is lengthened compared with that at the reference time. On the contrary, when the rotation speed of the secondary transfer roller 4 is lower than the reference rotation speed ω1*a*, the transport speed of the recording medium RM is lowered compared with the moving speed of the surface of the intermediate transfer belt 31, and the nip forming timing tCc is delayed from the timing tCa, and the tip end position FP of the toner image TI is located on a position near to the nip NP by the difference (=tCc−tCa). For this reason, in a lower rotation speed, the toner image on the intermediate transfer belt 31 reaches the nip NP earlier than the reference time. As a result, the distance between the toner image TI transferred on the recording medium RM and the tip end of the recording medium RM is shortened compared with the reference time. As described above, in this embodiment, by controlling the rotation speed ω1 of the secondary transfer roller 4, the nip forming timing tC is adjusted, and thereby the position on which the toner image TI on the intermediate transfer belt 31 is transferred on the recording medium RM can be adjusted with high accuracy.

Returning to FIG. 5, the description will continue. As described above, while the concave portion 41 is facing the intermediate transfer belt 31, at the same time or a slightly delayed time when the secondary transfer roller 4 reaches the recording medium gripping position, the controller 10 operates the gripper driving unit to move the tip end of the gripper member 442 to the tip end of the gripper support member 441 so as to grip the recording medium RM. Therefore, the operation of gripping the recording medium RM, that is, "Paper biting operation" is performed.

When the secondary transfer roller 4 rotates from the phase C (recording medium gripping position) by 34°, the phase A2 is detected by the sensor 8 at the timing tA2. Then, as described above, the driving control mode of the secondary transfer roller 4 by the driver 12 is switched from the position control to the torque control, and the secondary transfer operation is performed under the torque control.

Figure 7:
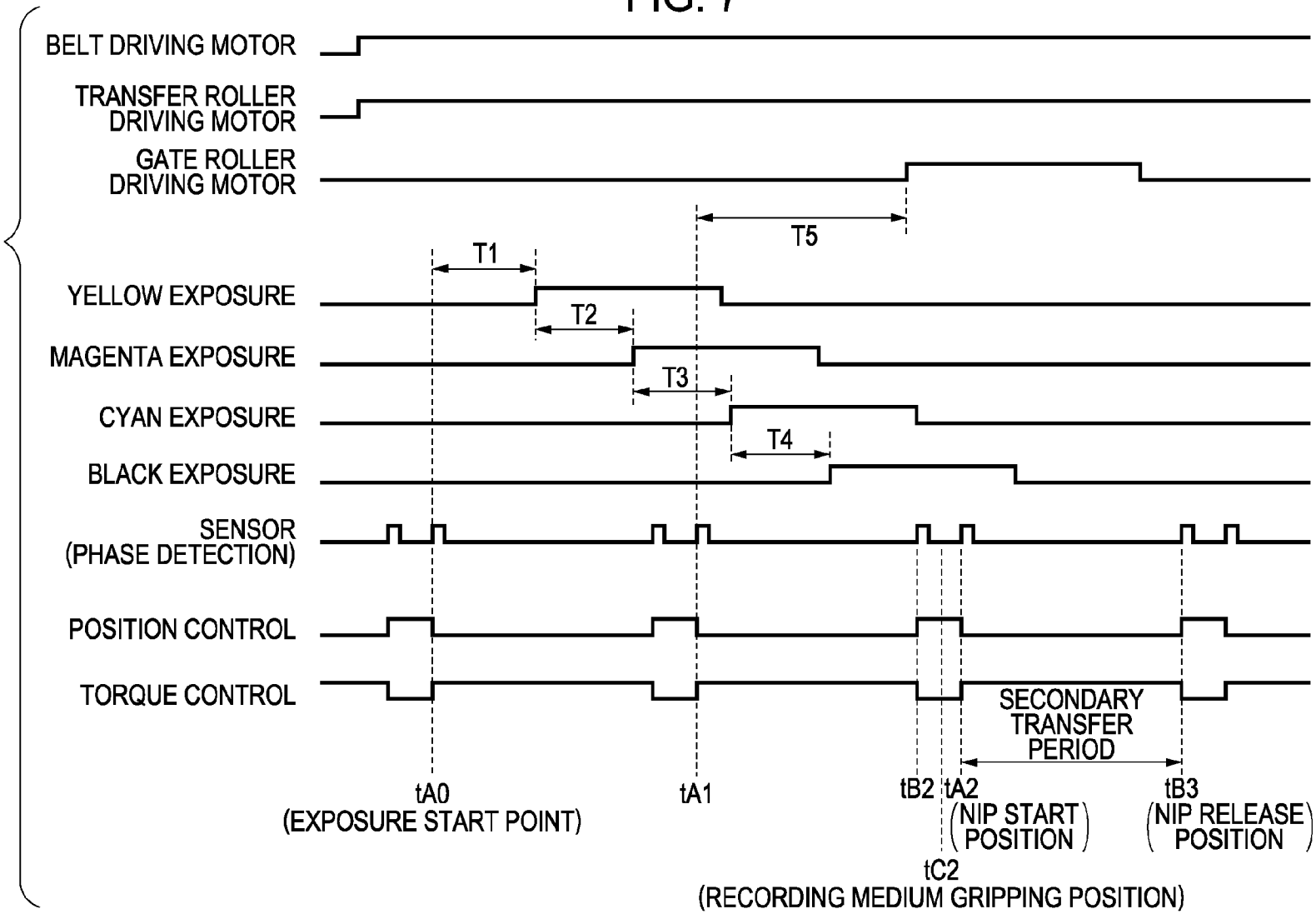
FIG. 7 is a timing chart illustrating an operation example of the image forming apparatus shown in FIG. 1.

Next, the operation of the image forming apparatus 1 as configured above will be described with reference to FIGS. 7 to 9A and 9B. FIG. 7 is a timing chart illustrating an operation example of the image forming apparatus shown in FIG. 1. In addition, FIGS. 8A to 8D, 9A and 9B are diagram schematically illustrating an operation of the image forming apparatus shown in FIG. 1. In the image forming apparatus 1, when an image forming command on forming a color image is given to the controller 10 from an external apparatus such as a host computer, the controller 10 controls each unit in the apparatus according to programs which is stored in a memory (not shown). First, the belt driving motor M3 and the transfer roller driving motor M4 operate so as to drive the intermediate transfer belt 31 and the secondary transfer roller 4, respectively. Then, whenever the secondary transfer roller 4 reaches the nip release position (phase B) and the nip start position (phase A), a level of a signal output to the controller 10 from the sensor element 82 changes temporarily from the L level to the H level. Then, the controller 10 switches the driving control mode of the secondary transfer roller 4 by the driver 12 on the basis of the change in the signal level between the position control and the torque control to each other as described above. Further, regarding the belt driving motor M3, the position control is always performed, and the surface of the intermediate transfer belt 31 moves peripherally at a predetermined moving speed.

In addition, when the controller 10 detects that the slit 811 is located in a detection range of the sensor element 82 of the phase detecting sensor 8 at the timing tA0 so that the secondary transfer roller 4 moves to the phase A (nip start position), the controller 10 switches the driving control mode of the driver 12 to be the torque control by the control switching signal and gives the command torque to the driver 12 so as to perform the torque control on the secondary transfer roller 4. In addition, the timing tA0 is set as the exposure start point, the controller forms the toner image by each of the image forming stations 2Y, 2M, 2C and 2K, and primarily transfers the toner image on the surface of the intermediate transfer belt 31. That is, as shown in FIG. 7, when the time T1 lapses from the timing tA0, the exposure unit 23 in the image forming station 2Y starts a latent image formation on the basis of various signals from the controller 10, and a toner image is formed with yellow toners. In addition, when the time T2 lapses from the start of yellow exposure, magenta exposure starts, and when the time T3 lapses from the start of the magenta exposure, cyan exposure starts, and when the time T4 lapses from the cyan exposure, black exposure starts. Therefore, each color of toner image is formed and overlapped on the intermediate transfer belt 31, so that a full color of toner image TI is formed on the surface of the intermediate transfer belt 31.

Figure 8A:
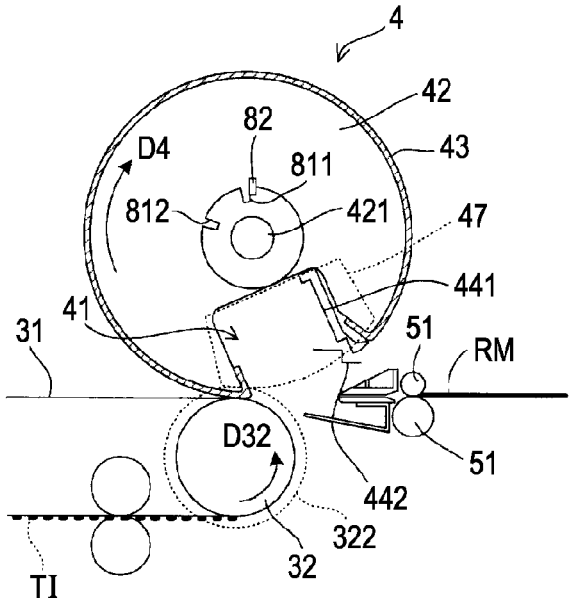
FIGS. 8A to 8D are diagrams schematically illustrating of an operation of the image forming apparatus shown in FIG. 1.

While each color of the toner image is being formed, the secondary transfer roller 4 rotates in the rotation direction D4, and returns to the phase A (nip start position) via the phase B (nip release position). When a predetermined time T5 lapses from the timing tA1, the controller 10 inputs a command pulse to a driver (not shown) which controls a gate roller driving motor connected to the gate rollers 51 and 51 so as to operate the gate roller driving motor. Therefore, the transportation of the recording medium RM to the secondary transfer position TR2 starts (FIG. 8A).

Figure 8B:
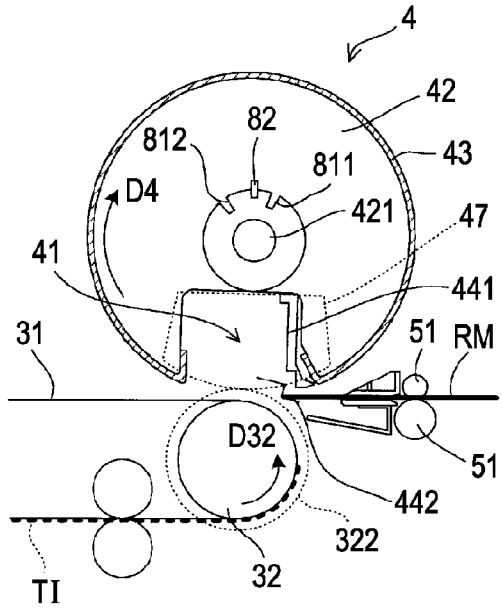

In addition, when the secondary transfer roller 4 is in the phase B (nip release position), the controller 10 prompts the driver 12 to switch the driving control mode from the torque control to the position control by a control switching signal at the corresponding timing tB2, and gives the command pulse to the driver 12. Therefore, as described above, the secondary transfer roller 4 moves by 29° in the rotation direction D4 so as to move to the recording medium gripping position. In addition, the tip end of the gripper member 442 is separated from the tip end of the gripper support member 441 so as to complete the grip preparation of the recording medium RM. Then, the tip end of the recording medium RM enters between the gripper member 442 and the gripper support member 441, and starts the paper biting operation (FIG. 8B).

Figure 8C:
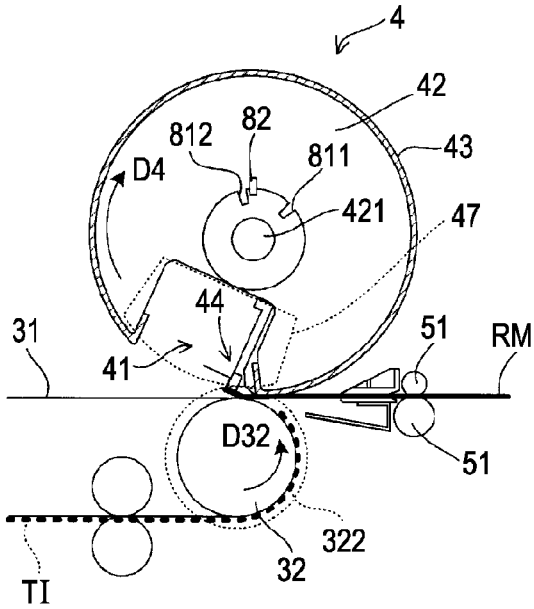

The controller 10 gives the grip command to a gripper driving unit (not shown) at the same or slightly delayed time as the timing tC. The gripper driving unit receives the grip command and operates, so that the tip end of the gripper member 442 is moved to the tip end of the gripper support member 441. Therefore, the tip end of the recording medium RM is gripped, and the "paper biting operation" is completed (FIG. 8C). Further, the "paper biting operation" is carried out before the secondary transfer roller 4 is in the phase A (nip start position), and at the point of time when the "paper biting operation" is completed, the toner image TI is located on the upstream side of the secondary transfer position TR2 in the moving direction D31 of the surface of the intermediate transfer belt 31 as shown in FIG. 8C.

While the tip end thereof being gripped by the grip unit 44, the recording medium RM is transported in the rotation direction D4 together with the secondary transfer roller 4. Then, before the recording medium reaches the phase A (nip start position) from the phase C (recording medium gripping position: see FIG. 5A), the controller 10 changes the command pulse to adjust the nip forming timing tC, so that a position of the toner image TI is adjusted with respect to the recording medium RM.

Figure 8D:
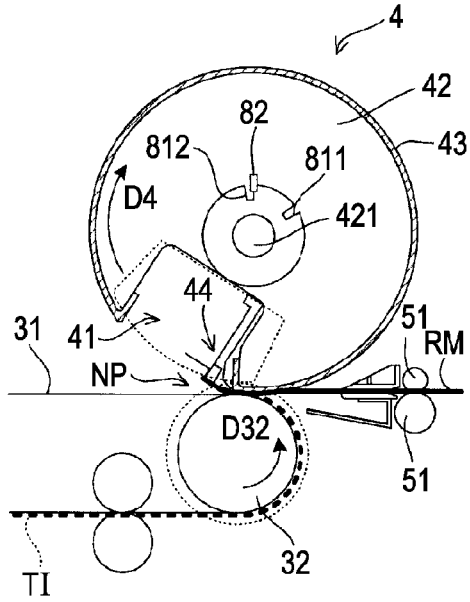

When the secondary transfer roller 4 reaches the phase A (nip start position), the elastic layer 43 of the secondary transfer roller 4 contacts with the surface of the intermediate transfer belt 31 from the timing tA2 so as to form the nip NP, and interposes and transports the recording medium RM. Therefore, the secondary transfer of the toner image TI formed on the intermediate transfer belt 31 onto the lower surface (surface) of the recording medium RM starts (FIG. 8D). In addition, the controller 10 prompts the driver 12 to switch the driving control mode to the torque control by the control switching signal at the timing tA2, and gives the command torque to the driver 12 so as to control the secondary transfer roller 4.

Figure 9A:
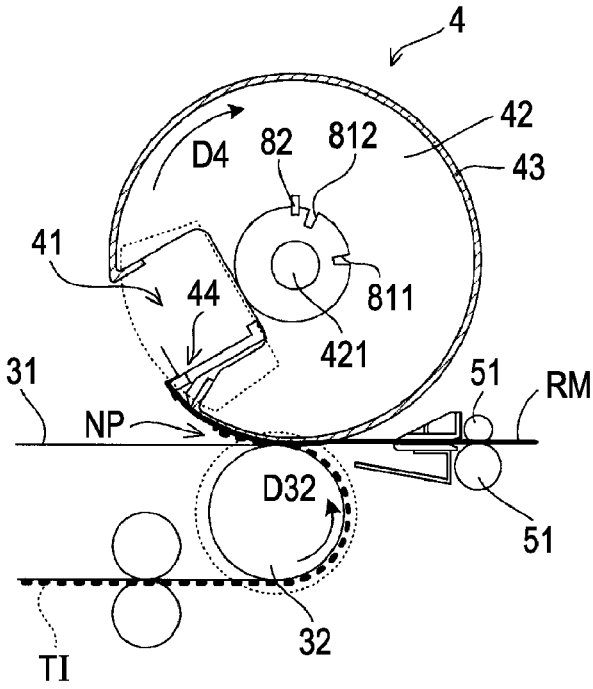
FIGS. 9A and 9B are diagrams schematically illustrating an operation of the image forming apparatus shown in FIG. 1.
Figure 9B:
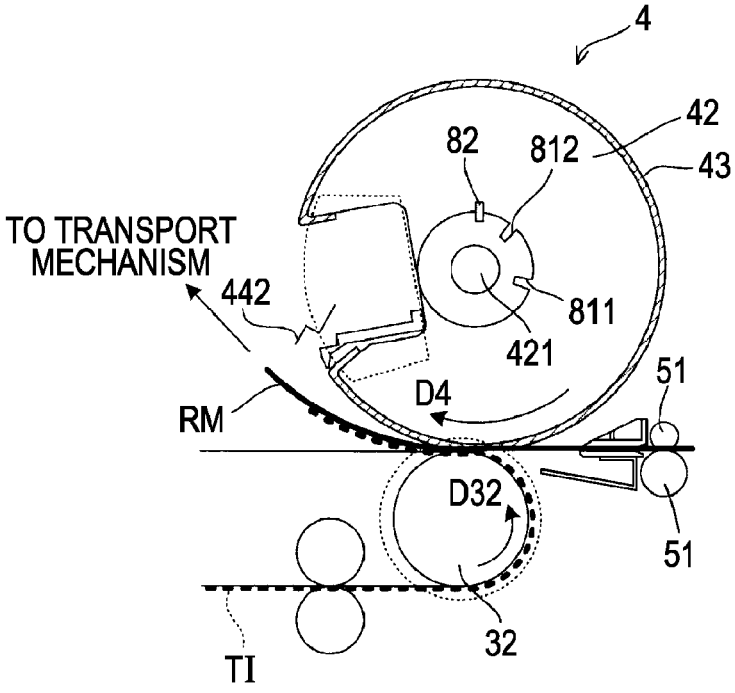

While being subjected to the torque control, the secondary transfer roller 4 rotates in the rotation direction D4, and also the recording medium RM passes through the nip NP in a state where the tip end thereof is held on the grip unit 44, so that the secondary transfer of the toner image TI progresses (FIG. 9A). Then, when the grip unit 44 moves up to the proximity position of the upstream end (which is the end on the right end side of FIG. 1) of the transport mechanism 6, the tip end of the recording medium held on the grip unit 44 is sufficiently separated from the intermediate transfer belt 31 so as to be transported up to a transport inlet of the transport mechanism 6. Then, in this embodiment, as shown in FIG. 9B, the controller 10 gives the gripper driving unit the release command at the timing when the grip unit 44 moves to the vicinity of the upstream end of the transport mechanism 6, separates the tip end of the gripper member 442 from the tip end of the gripper support member 441 so as to release the gripping of the recording medium RM. Therefore, the tip end of the recording medium RM is fed into the transport inlet of the transport mechanism 6, and transported to the fixing unit 7 via the transport mechanism 6. Then, the fixing of the toner image TI onto the recording medium RM is carried out by the fixing unit 7. Further, after the releasing, the tip end of the recording medium RM is transported to the fixing unit 7 along the transport path PT by the transport mechanism 6, and while the back end of the recording medium RM is nipped and transported in the nip NP by the elastic layer 43 of the secondary transfer roller 4 and the intermediate transfer belt 31, the secondary transfer process is performed.

As described above, according to the first embodiment, the toner image TI on the intermediate transfer belt 31 is transferred on a position corresponding to the nip forming timing in the recording medium RM by adjusting the nip forming timing tC. Therefore, the position of the toner image TI with respect to the recording medium RM can be adjusted with high accuracy by adjusting the nip forming timing tC.

In addition, in the first embodiment, operational advantages are obtained as follows. In other words, while the concave portion 41 is facing the intermediate transfer belt 31, that is, until the secondary transfer roller 4 reaches the phase A (nip start position) from the phase B (nit release position), the driving control mode of the driver 12 is switched to the position control so as to make the transfer roller driving motor M4 to be in the position control. Therefore, the secondary transfer roller 4 can be accurately positioned on the recording medium gripping position, and the recording medium RM can be accurately gripped by the grip unit 44. On the other hand, while the elastic layer 43 faces the intermediate transfer belt 31 to form the nip NP and thus the secondary transfer process is being carried out, that is, until the secondary transfer roller 4 reaches the phase B (nip release position) from the phase A (nip start position), the transfer roller driving motor M4 is subjected to the torque control. Therefore, the load applied on the intermediate transfer belt 31 can be suppressed not to be changed, so that the intermediate transfer belt 31 can be stably driven. As a result, the degradation in image quality caused by the speed change of the intermediate transfer belt 31 can be effectively prevented.

In addition, the torque control is carried out while the nip NP is being formed. However, there are a case where the recording medium RM passes through the nip NP and a case where the recording medium RM does not pass through, the loads applied on the intermediate transfer belt 31 in both cases are different from each other. Therefore, when the controller 10 changes the command torque in both cases, the change in the load applied on the intermediate transfer belt 31 can be further suppressed, which is suitable.

In addition, even when the recording medium RM passes through the nip NP, if a thickness, a material, a size and a shape of the recording medium RM are different, the load on the intermediate transfer belt 31 is differentiated. Therefore, when the controller 10 changes the command torque according to the kind of recording medium RM, the change in the load applied on the intermediate transfer belt 31 can be further suppressed, which is suitable.

Furthermore, in the above-mentioned embodiment, the controller 10 is provided with a command torque calculating unit 10*a*, the command torque corresponding to the load state of the intermediate transfer belt 31 is calculated on the basis of a signal given to the belt driving motor M3 from the driver 11, and the transfer roller driving motor M4 is subjected to the torque control by the command torque. The torque control of the roller driving unit is carried out such that the transfer roller driving motor M4 is subjected to the feedback control on the basis of information (which is a signal given to the belt driving motor M3 from the driver 11) relating to the load applied on the intermediate transfer belt 31. For this reason, the secondary transfer roller 4 comes to operate suitably to the load state applied on the intermediate transfer belt 31, so that the intermediate transfer belt 31 can be further stably driven, and the degradation in image quality can be effectively prevented.

Figure 10:
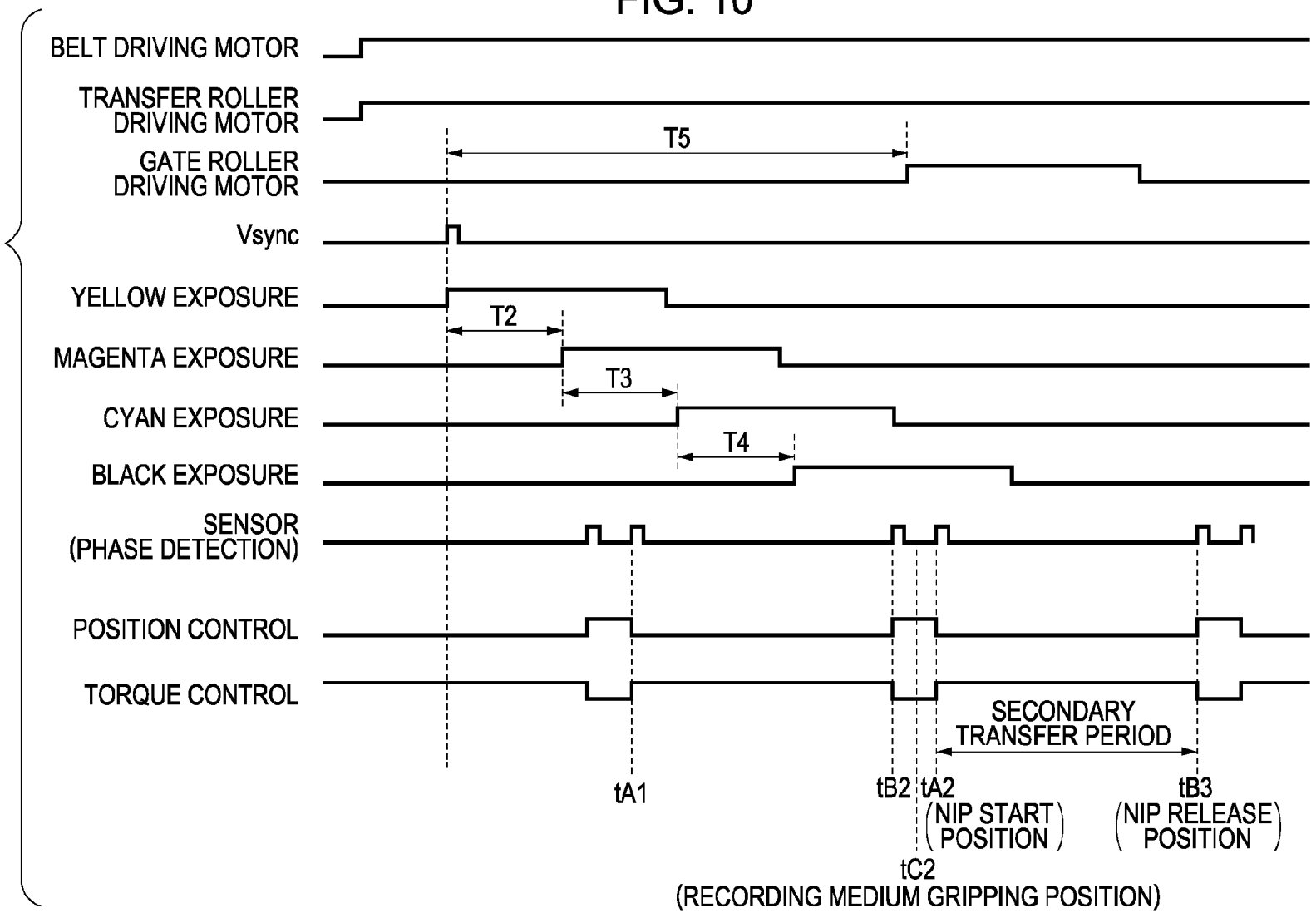
FIG. 10 is a diagram illustrating an image forming apparatus according to a second embodiment of the invention.

FIG. 10 is a diagram illustrating the image forming apparatus according to the second embodiment of the invention, which shows the operation of the image forming apparatus. The second embodiment is largely different from the first embodiment in the setting of the reference signal. That is, in the first embodiment, as shown in FIG. 7, the output signal of the sensor 8 is set as the reference signal, the exposure process or the transport process of the recording medium RM is controlled on the basis of the change in output level from the sensor 8 when the secondary transfer roller 4 moves to the phase A (nip start position). On the other hand, in the second embodiment, so-called vertical synchronization signal is set to the reference signal. In other words, as is well known from the related art, as for the image forming apparatus which uses the intermediate transfer belt, the intermediate transfer drum or the like as the image carrier, there is commercially available a scheme in which each part of the apparatus is controlled by using a vertical synchronization signal which is output when a specific portion (for example, a notch or a protrusion) fixedly provided at the image carrier is detected by a vertical synchronization sensor. The invention may be applied even to such an image forming apparatus, and as shown in FIG. 10 the vertical synchronization signal Vsync is set as the reference signal, the exposure process, the transport process of the recording medium RM or the like may be controlled. Further, detailed control contents are the same as that of the first embodiment, and the same operational advantage as the first embodiment can be also obtained in the second embodiment.

Figure 11:
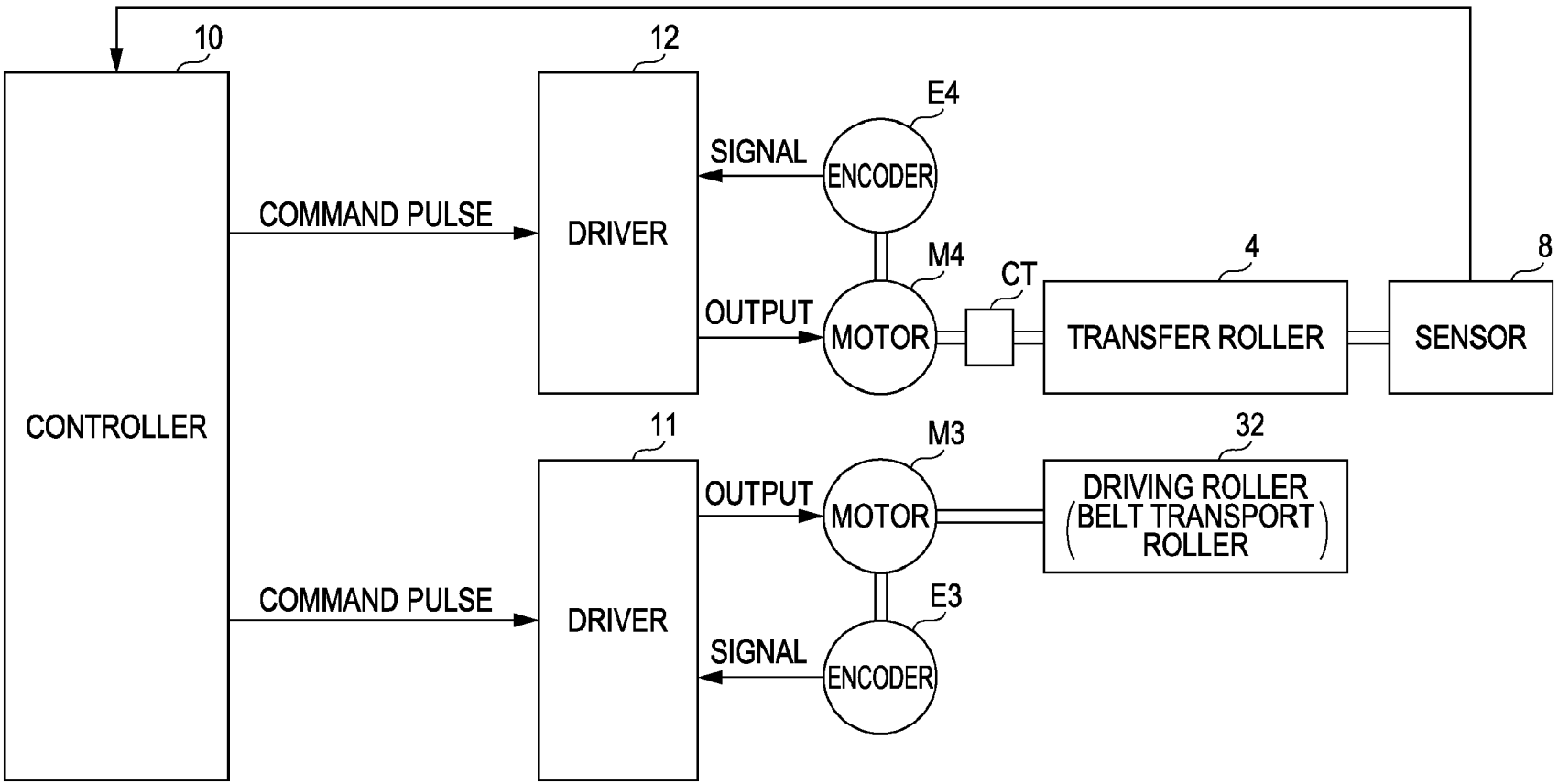
FIG. 11 is a diagram illustrating an image forming apparatus according to a third embodiment of the invention.
Figure 12:
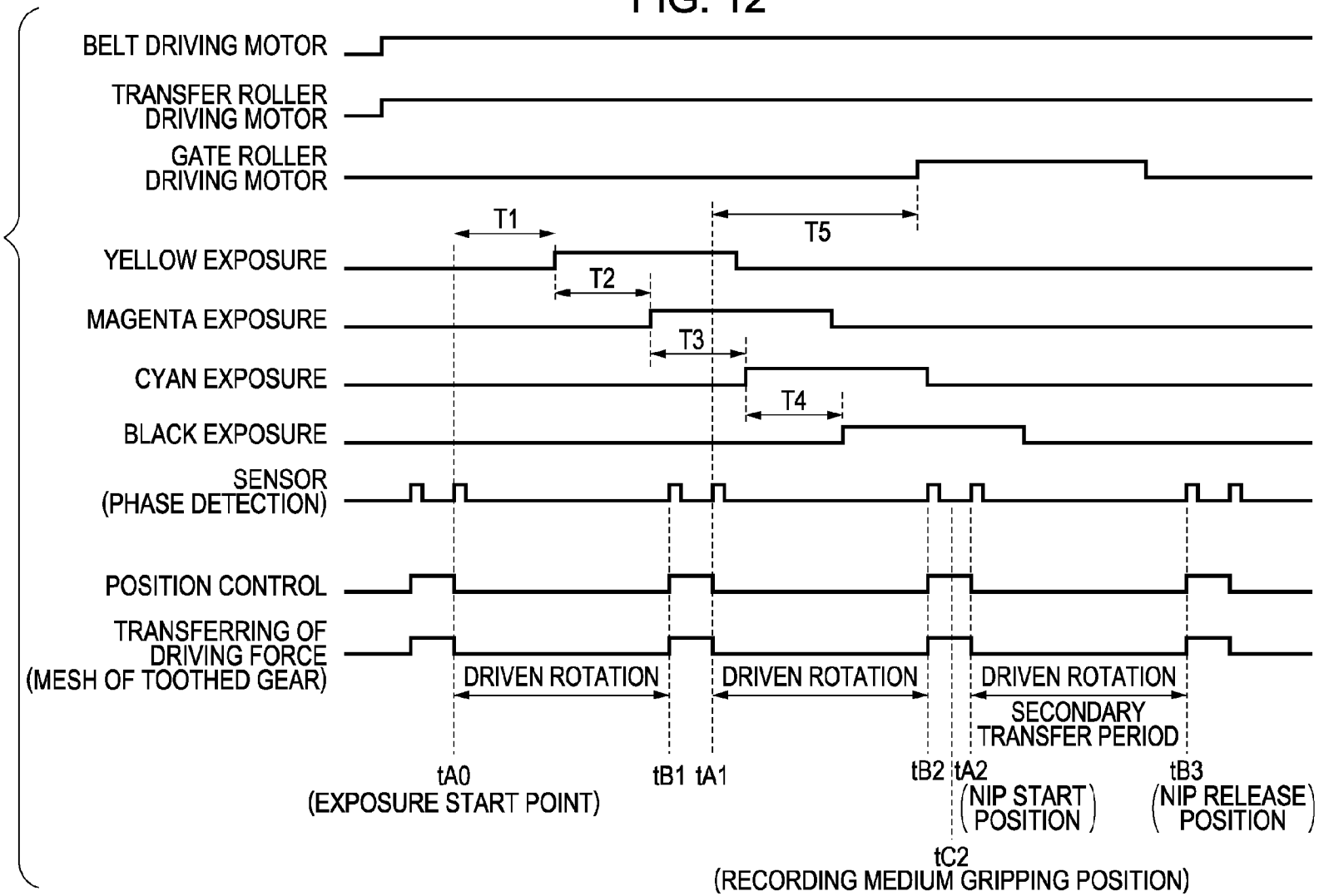
FIG. 12 is a timing chart illustrating an operational example of the image forming apparatus shown in FIG. 11.

FIG. 11 is a diagram illustrating the image forming apparatus according to the third embodiment of the invention, and FIG. 12 is a timing chart illustrating an operational example of the image forming apparatus shown in FIG. 11. The third embodiment is largely different from the first embodiment in two points. Firstly, a first point is that only a command pulse is given to the driver 12 from the controller 10, that is, only the position control is prepared as the driving control mode by the driver 12. In addition, a second point is that a one-way clutch CT is interposed between the transfer roller driving motor M4 and the secondary transfer roller 4. In the third embodiment, by providing the one-way clutch CT, while the elastic layer 43 of the secondary transfer roller 4 is facing the intermediate transfer belt 31 (from the phase A to the phase B), a driving force generated by the transfer roller driving motor M4 is blocked to be transferred to the secondary transfer roller 4, and the secondary transfer roller 4 is rotatably driven with respect to the intermediate transfer belt 31 by a frictional force between the elastic layer 43 and the nip NP of the intermediate transfer belt 31. On the other hand, while the concave portion 41 of the secondary transfer roller 4 is facing the intermediate transfer belt 31 (from the phase B to the phase A), a driving force is transferred to the secondary transfer roller 4 so as to perform the position control. Therefore, the image forming apparatus according to the third embodiment forms an image as shown in FIG. 12.

When an image forming command indicating formation of a color image is given to controller 10 from an external apparatus such as a host computer, the belt driving motor M3 and the transfer roller driving motor M4 are operated so as to drive the intermediate transfer belt 31 and the secondary transfer roller 4, and at the timing tA0, the controller 10 detects that the secondary transfer roller 4 moves to the phase A (nip start position). Then, the timing tA0 is set as the exposure start point, and as in the first embodiment, a toner image is formed by each of the image forming stations 2Y, 2M, 2C and 2K, and the toner image is primarily transferred onto the surface of the intermediate transfer belt 31.

While the toner image is being formed, since the elastic layer 43 faces the intermediate transfer belt 31 from the timing tA0 so as to form the nip NP, the secondary transfer roller 4 is rotatably driven with respect to the intermediate transfer belt 31. Then, when the secondary transfer roller 4 reaches the phase B (nip release position) at the timing tB1, the concave portion 41 of the secondary transfer roller 4 faces the intermediate transfer belt 31, and until it comes into the phase A, the controller 10 prompts the driver 12 to be subjected to the position control. In addition, the elastic layer 43 faces again the intermediate transfer belt 31 at the next timing tA2 so as to form the nip NP, and this state continues until the timing tB2 and between the timings tA1 to tB2, the secondary transfer roller 4 is rotatably driven with respect to the intermediate transfer belt 31. In addition, also in the third embodiment, as in the first embodiment, when a predetermined time T5 lapses from the timing tA1, the controller 10 inputs a command pulse to the driver (not shown) which controls the gate roller driving motor connected to the gate rollers 51 and 51 so as to operate the gate roller driving motor. Therefore, the transportation of the recording medium RM to the secondary transfer position TR2 starts.

In addition, when being in the phase B (nip release position), the secondary transfer roller 4 is subjected to the position control from the timing tB2 on the basis of the command pulse output from the controller 10 and the secondary transfer roller 4 moves in the rotation direction D4 by 29° so as to move to the recording medium gripping position (timing tC2: phase C). In addition, the tip end of the gripper member 442 is separated from the tip end of the gripper support member 441 so as to complete the grip preparation of the recording medium RM. Then, the tip end of the recording medium RM is gripped by the grip unit 44 (paper biting operation). Therefore, while the tip end of the recording medium RM is being gripped by the grip unit 44, the recording medium RM is transported in the rotation direction D4 together with the secondary transfer roller 4. Then, before the recording medium RM reaches to the phase A (nip start position) from the phase C (recording medium gripping position: see FIG. 5A), the controller 10 changes the command pulse as described above so as to adjust the nip forming timing tC, so that a position of the toner image TI is adjusted with respect to the recording medium RM.

When the secondary transfer roller 4 reaches the phase A (nip start position), the elastic layer 43 faces again the intermediate transfer belt 31 so as to form the nip NP, and the secondary transfer roller 4 is rotatably driven with respect to the intermediate transfer belt 31. In addition, according to the rotatable driven of the secondary transfer roller 4, the recording medium RM passé through the nip NP in a state where the tip end of the recording medium RM is held on the grip unit 44, so that the secondary transfer of the toner image TI progresses. Thereafter, as in the first embodiment, the recording medium RM is transported to the fixing unit 7 via the transport mechanism 6, and the fixing of the color toner image TI is carried out onto the recording medium RM.

As described above, also in the third embodiment, similarly to the first embodiment, by adjusting the nip forming timing tC, a position of the toner image TI can be adjusted with high accuracy with respect to the recording medium RM. In addition, since the secondary transfer roller 4 is rotatably driven with respect to the intermediate transfer belt 31 during the time from the phase A to the phase B, the same operational advantage as the first embodiment, of which torque control is performed in the period (from phase A to phase B) is obtained.

Figure 13B:
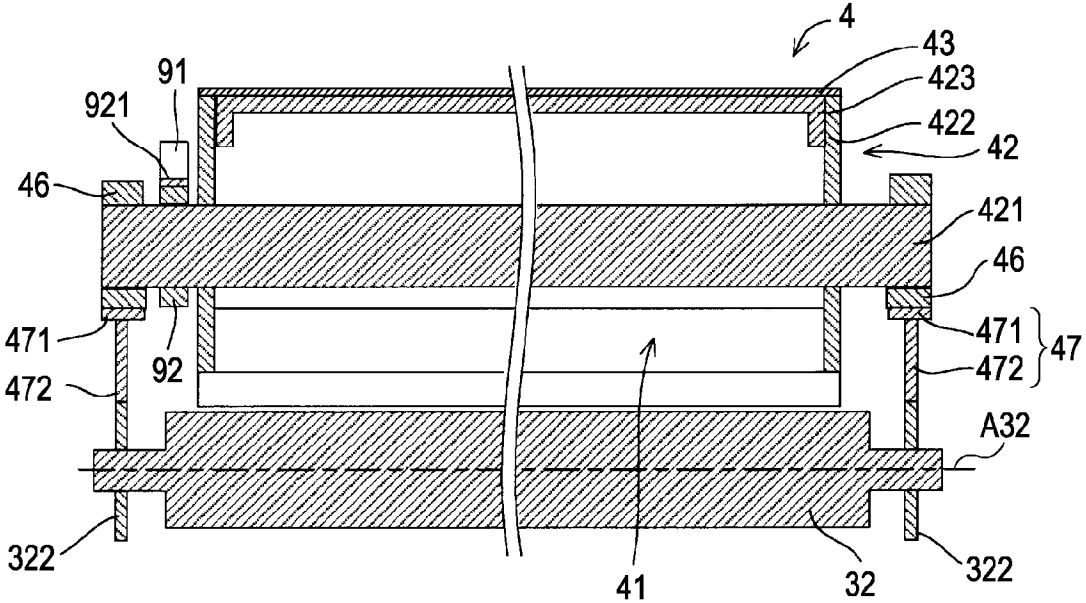
FIGS. 13A to 13C are diagrams illustrating an image forming apparatus according to a fourth embodiment of the invention.
Figure 13A:
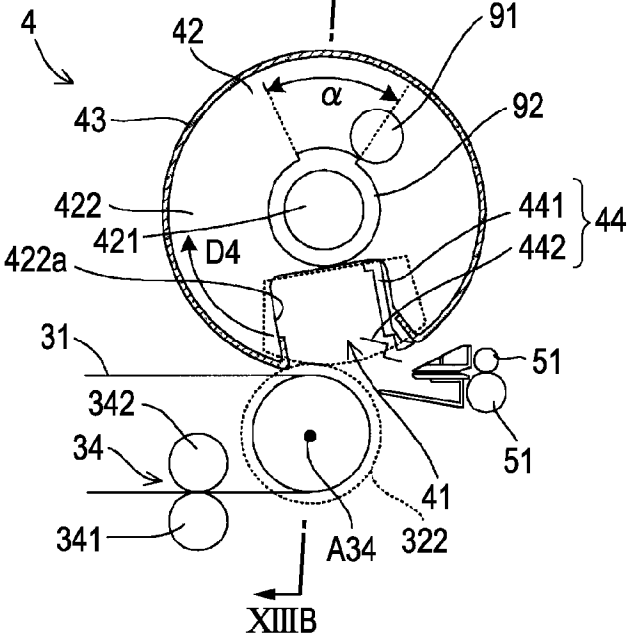
Figure 13C:
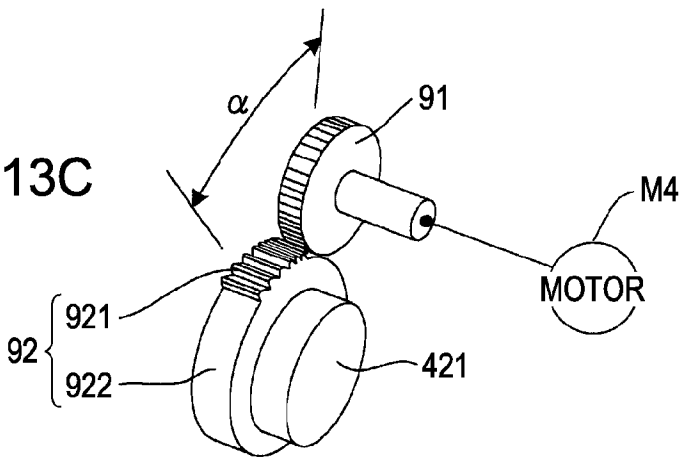

FIG. 13 is a diagram illustrating the image forming apparatus according to the fourth embodiment of the invention. The fourth embodiment is largely different from the first embodiment in that the controller 10 gives only the command pulse to the driver 12, that is, only the position control is prepared as the driving control mode by the driver 12, and in that a driving force generated by the transfer roller driving motor M4 is transferred to the secondary transfer roller 4 via toothed gears 91 and 92. The toothed gear 91 on the motor side among the toothed gears is a spur gear in which a toothed gear portion is formed over the entire peripheral surface, and the toothed gear 92 is a partially toothed gear which includes a toothed gear portion 921 meshed with the toothed gear 91 and a partially toothed gear portion 922 which is not meshed with the toothed gear 91. In the fourth embodiment, the toothed gear portion 921 is formed in correspondence with an angle range α (63° in this embodiment). The partially toothed gear 92 is attached to the end of the rotation shaft 421 such that when the secondary transfer roller 4 is in the phase B, the toothed gear portion 921 in the rotation direction D4 begins to be meshed with the toothed gear 91, and when the secondary transfer roller 4 is in the phase A, the toothed gear portion 921 in the rotation direction D4 is separated from the toothed gear 91. Therefore, only while the secondary transfer roller 4 is being between the phase B (nip release position) and the phase A (nip start position), a driving force generated by the transfer roller driving motor M4 is transferred to the secondary transfer roller 4 via the toothed gears 91 and 92. On the other hand, while the elastic layer 43 of the secondary transfer roller 4 is facing the intermediate transfer belt 31 (from phase A to the phase B), a driving force generated by the transfer roller driving motor M4 is not transferred to the secondary transfer roller 4, and the secondary transfer roller 4 is rotatably driven by a frictional force in the nip NP between the elastic layer 43 and the intermediate transfer belt 31 with respect to the intermediate transfer belt 31. Therefore, in the fourth embodiment, the image forming is carried out exactly similar to the third embodiment (see FIG. 12). Accordingly, also in the fourth embodiment, the same operational advantage as the third embodiment is obtained.

Figure 14:
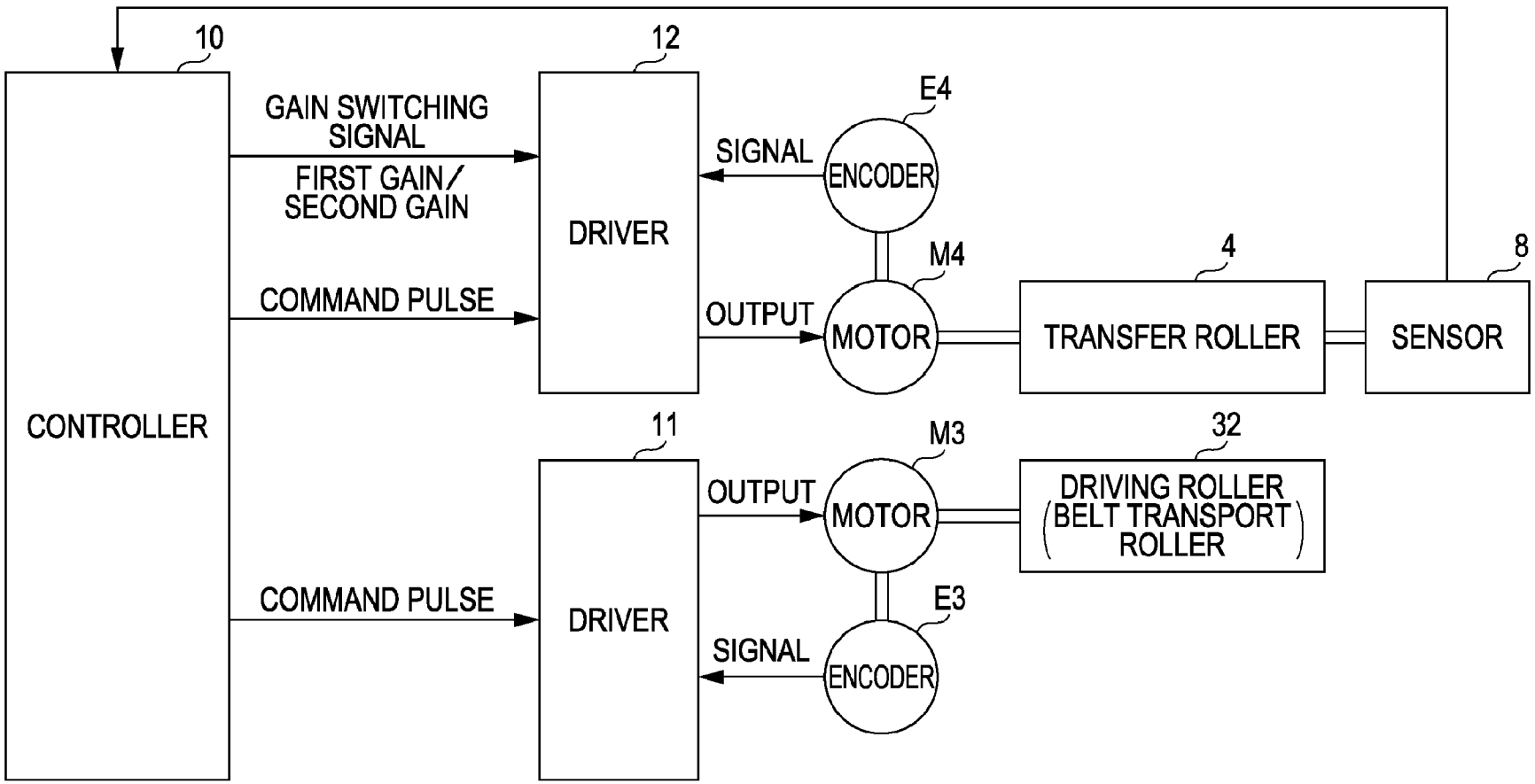
FIG. 14 is a diagram illustrating an image forming apparatus according to a fifth embodiment of the invention.

FIG. 14 is a diagram illustrating the image forming apparatus according to the fifth embodiment of the invention. The fifth embodiment is largely different from the first embodiment in two points. Firstly, a first point is that only a command pulse is given to the driver 12 from the controller 10, that is, only the position control is prepared as the driving control mode by the driver 12. In addition, a second point is that a gain switching signal is given to the driver 12 so that a position control gain can be switched in two steps. In the fifth embodiment, regardless of the phase of the secondary transfer roller 4, the motor M4 is subjected to the position control according to the command pulse, and the position control gain is switched as follows. That is, while the concave portion 41 of the secondary transfer roller 4 is facing the intermediate transfer belt 31 (from the phase B to the phase A), the position control is set to a first gain which is comparatively large so as to position the secondary transfer roller 4 with high accuracy. On the other hand, while the elastic layer 43 of the secondary transfer roller 4 is facing the intermediate transfer belt 31 (from the phase A to the phase B), the position control gain is set to a second gain which is smaller than the first gain so as to suppress the change in the load applied on the intermediate transfer belt 31 compared with the case where the position control is carried out with the first gain as described above.

Figure 15:
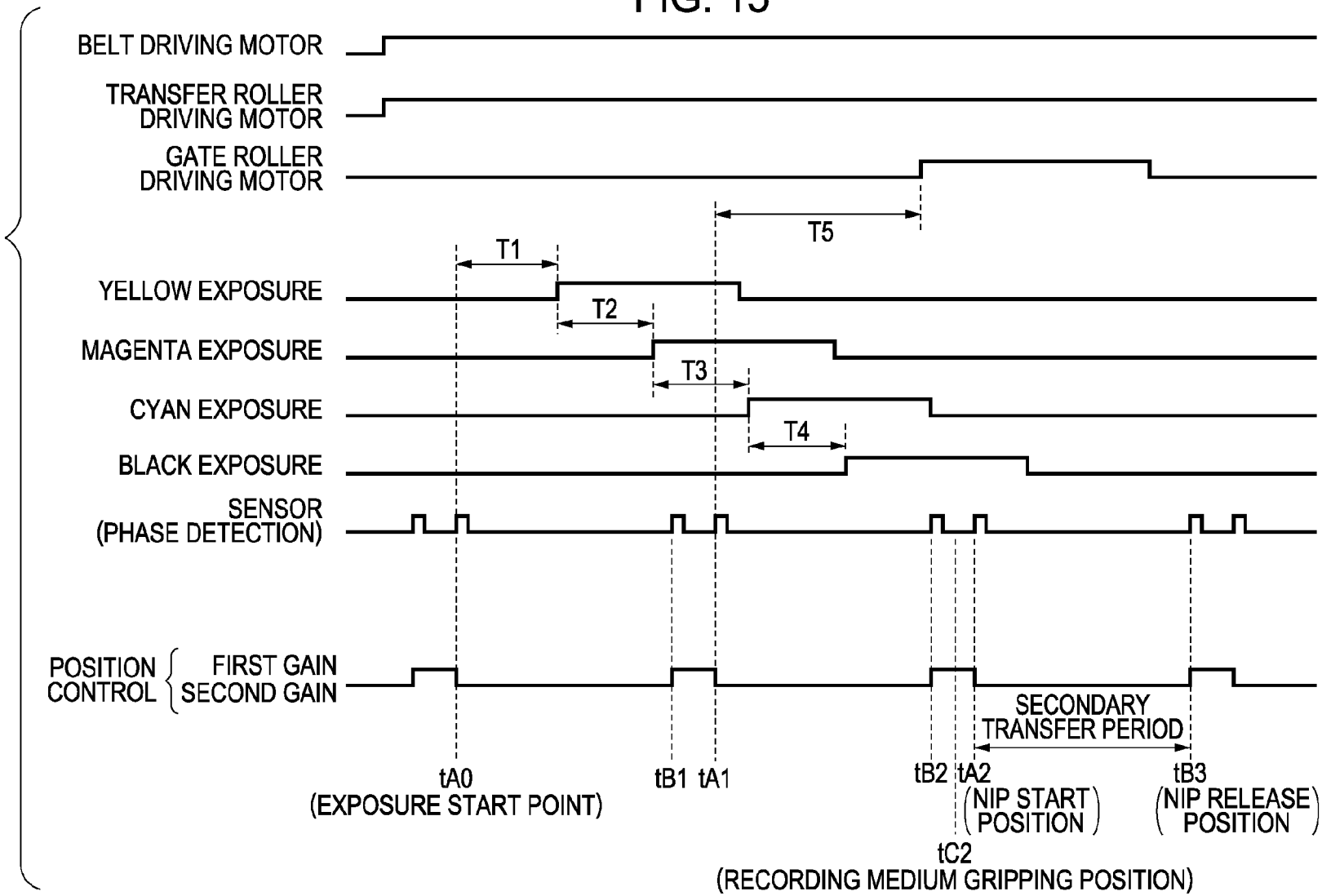
FIG. 15 is a timing chart illustrating an operation of the image forming apparatus shown in FIG. 14.

FIG. 15 is a timing chart illustrating the operational example of the image forming apparatus shown in FIG. 14. In the fifth embodiment, when an image forming command on forming a color image is given to the controller 10 from an external apparatus such as a host computer, the belt driving motor M3 and the transfer roller driving motor M4 operate so as to drive the intermediate transfer belt 31 and the secondary transfer roller 4, and the controller 10 detects that the secondary transfer roller 4 moves to the phase A (nip start position) at the timing tA0. Then, the timing tA0 is set as the exposure start point, similar to the first embodiment, the controller forms the toner image by each of the image forming stations 2Y, 2M, 2C and 2K, and primarily transfers the toner image on the surface of the intermediate transfer belt 31.

In addition, while the toner image is being formed, the controller 10 gives the command pulse to the driver 12 at the timing tA0 so as to subject the secondary transfer roller 4 to the position control, and sets the position control gain to the comparatively small second gain by the gain switching signal. Then, when the secondary transfer roller 4 reaches the phase B (nip release position) at the timing tB1, the controller 10 sets the position control gain to the comparatively large first gain by the gain switching signal, and until the secondary transfer roller 4 comes into the phase A, the controller 10 prompts the driver 12 to be subjected to the position control with the first gain. In addition, when the elastic layer 43 faces again the intermediate transfer belt 31 at the next timing tA1 so as to form the nip NP, the controller 10 sets the position control gain to the above-mentioned second gain again by the gain switching signal. In addition, also in the fifth embodiment, as in the first embodiment, when a predetermined time T5 lapses from the timing tA1, the controller 10 inputs the command pulse to the driver (not shown) which controls the gate roller driving motor connected to the gate rollers 51 and 51. Therefore, the transportation of the recording medium RM to the secondary transfer position TR2 starts.

In addition, when the secondary transfer roller 4 is in the phase B (nip release position), the controller 10 sets the position control gain to the above-mentioned first gain again by the gain switching signal. Therefore, the secondary transfer roller 4 is subjected to the position control with high accuracy. More specifically, the secondary transfer roller 4 is subjected to the position control with the comparatively large gain (first gain) on the basis of the command pulse which is output from the controller 10 at the above-mentioned timing tB2, so that the secondary transfer roller 4 moves in the rotation direction D4 by 29° so as to move to the recording medium gripping position (timing tC2: phase C). In addition, the tip end of the gripper member 442 is separated from the tip end of the gripper support member 441 so as to complete the grip preparation of the recording medium RM. Then, the tip end of the recording medium RM is gripped by the grip unit 44 (paper biting operation). Therefore, while the tip end of the recording medium RM is gripped by the grip unit 44, the recording medium RM is transported in the rotation direction D4 together with the secondary transfer roller 4. Then, before the recording medium RM reaches the phase A (nip start position) from the phase C (recording medium gripping position: see FIG. 5A), the controller 10 changes the command pulse as described above so as to adjust the nip forming timing tC and to adjust the position of the toner image TI with respect to the recording medium RM.

When the secondary transfer roller 4 reaches the phase A (nip start position), the controller 10 sets the position control gain to the above-mentioned second gain by the gain switching signal so as to suppress the change in the load applied on the intermediate transfer belt 31. In addition, as the rotation of the secondary transfer roller 4, the recording medium RM passes through the nip NP in a state where the tip end thereof is held on the grip unit 44, so that the secondary transfer of the toner image TI progresses. Thereafter, similarly to the first embodiment, the recording medium RM is transported to the fixing unit 7 via the transport mechanism 6, and the fixing of the color toner image TI to the recording medium RM is carried out.

As described above, also in the fifth embodiment, similarly to the first embodiment, a position of the toner image TI can be adjusted with respect to the recording medium RM with high accuracy by adjusting the nip forming timing tC. In addition, since the position control gain is large while the concave portion 41 is facing the intermediate transfer belt 31, the secondary transfer roller 4 can be accurately positioned on the recording medium gripping position, and the recording medium RM can be securely gripped by the grip unit 44. On the other hand, while the elastic layer 43 is facing the intermediate transfer belt 31 so as to form the nip NP and to carry out the secondary transfer process, that is, while the secondary transfer roller 4 reaches the phase B (nip release position) from the phase A (nip start position), since the secondary transfer roller 4 is subjected to the position control with the comparatively small second gain, the change in the load applied on the intermediate transfer belt 31 can be suppressed, and the intermediate transfer belt 31 can be stably driven. As a result, the degradation in image quality caused by the speed change of the intermediate transfer belt 31 can be effectively prevented.

Figure 16A:
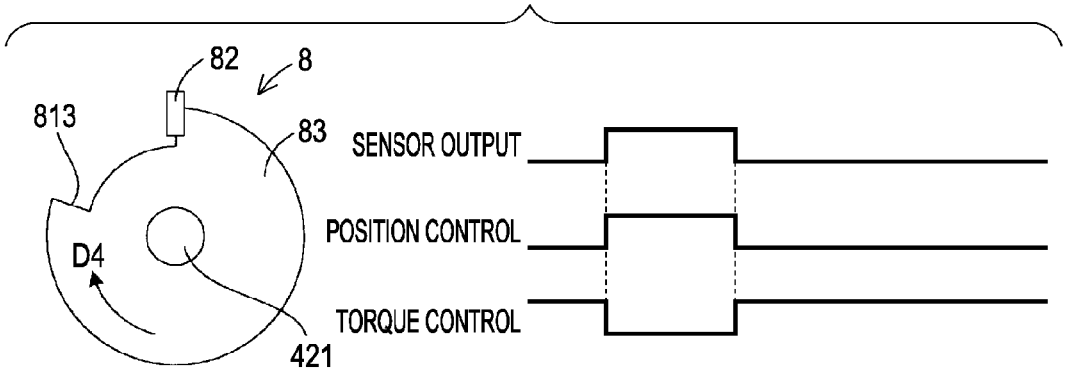
FIGS. 16A to 16C are diagrams illustrating an image forming apparatus according to another embodiment of the invention.

Further, the invention is not limited to the above-mentioned embodiments, but various changes other than the above-mentioned embodiment can be made without departing from the main points thereof. For example, in the above-mentioned embodiments, the description has been made such that the phase detecting sensor 8 is configured to include the slit plate 81 having two slits 811 and 812 and the sensor element 82, but the configuration of the phase detecting sensor 8 is not limited thereto. For example, as shown in FIG. 16A, instead of the slit plate 81, a disk-shape member 83 which is provided with a notched portion 813 over an angle range $\alpha$ in which the concave portion 41 faces the intermediate transfer belt 31. In the phase detecting sensor 8 as configured above, when the secondary transfer roller 4 is in the phase B (nip release position), the downstream end of the notched portion 813 in the rotation direction D4 passes through the sensor element 82, so that the sensor output is changed from the L level to the H level. In addition, when the secondary transfer roller 4 is in the phase A (nip start position), the upstream end of the notched portion 813 passes through the sensor element 82, so that the sensor output is changed from the H level to the L level. As described above, the phase A and phase B are detected on the basis of the change in the output level, and similarly to the above-mentioned embodiments the driving control mode of the transfer roller driving motor M4 by the driver 12 is switched between the torque control and the position control.

Figure 16B:
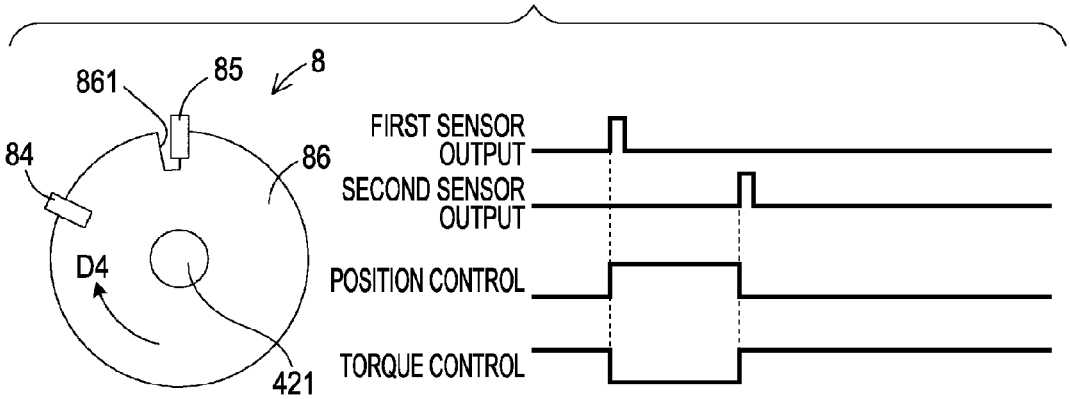

In addition, in the phase detecting sensor 8 shown in FIG. 16B, two sensor elements 84 and 85 and one slit plate 86 are provided. The sensor elements 84 and 85 are disposed such that an angle from the first sensor element 84 to the second sensor element 85 is matched with the angle range $\alpha$ along the rotation direction D4. In addition, the slit plate 86 is provided with one slit 861, and the slit plate 86 rotates in the rotation direction D4 together with the rotation shaft 421. Then, when the secondary transfer roller 4 is in the phase B (nip release position), the slit 861 passes through the first sensor element 84, so that the output of the first sensor element 84 is changed from the L level to the H level. Furthermore, when the secondary transfer roller 4 is in the phase A (nip start position), the slit 861 passes through the second sensor element 85, so that the output of the second sensor element 85 is changed from the L level to the H level. As described above, the phase A and phase B are detected on the basis of the output level, and similarly to the above-mentioned embodiments the driving control mode of the transfer roller driving motor M4 by the driver 12 is switched between the torque control and the position control.

Figure 16C:
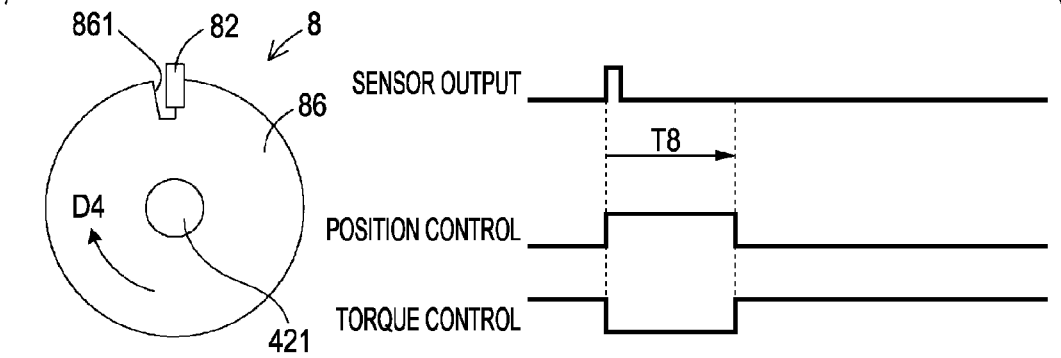

In addition, in the phase detecting sensor 8 shown in FIG. 16C, the sensor element 82 and the slit plate 86 are provided, and when the secondary transfer roller 4 is in the phase B (nip release position), the slit 861 passes through the sensor element 82, so that the output of the sensor element 82 is changed from the L level to the H level. Then, the controller 10 starts time measurement by being triggered by the change in the output level, and when a lapsed time reaches a predetermined time T8 (which is a time necessary for the secondary transfer roller 4 to reach the phase A from the phase B), it may detect that the secondary transfer roller 4 is in the phase A (nip start position). As described above, by assembling the time measurements of the phase detecting sensor 8 and the controller 10, the phase A and the phase B are detected, and similarly to the above-mentioned embodiments the driving control mode of the transfer roller driving motor M4 by the driver 12 is switched between the torque control and the position control.

Furthermore, in the above-mentioned embodiments, the invention is applied to the image forming apparatus which secondarily transfers the toner image formed on the surface of the intermediate transfer belt 31 onto the recording medium RM, but the invention may be applied to an image forming apparatus which secondarily transfers the toner image formed on an intermediate transfer drum onto the recording medium, or to an image forming apparatus which transfers the toner image formed on a photosensitive body onto the recording medium.

The entire disclosure of Japanese Patent Application No: 2009-97977, filed Apr. 14, 2009 is expressly incorporated by reference herein.

What is claimed is:

1. An image forming apparatus comprising:

an image carrier that moves at a predetermined speed while carrying an image;

a transfer roller that includes a roller base material, a concave portion that is provided on a peripheral surface of the roller base material, a grip unit that is disposed on the concave portion and grips a recording medium, a sensor connected to an end of a rotation shaft of the transfer roller being configured to detect a rotation phase of the transfer roller, and an elastic layer that is disposed on a peripheral surface of the roller base material, the transfer roller that grips recording medium by the grip unit when the concave portion faces the image carrier and passes the recording medium through a nip that is formed between the image carrier and the elastic layer when making contact with each other so that the image carried on the image carrier is transferred on the recording medium;

a roller driving unit that rotates the roller base material; and a control unit that controls the roller driving unit so as to adjust a timing for forming the nip.

2. The image forming apparatus according to claim 1, wherein the control unit controls a rotation speed of the roller base material when the concave portion faces the image carrier so as to adjust the timing for forming the nip.

3. The image forming apparatus according to claim 2, wherein the control unit prompts the grip unit to grip the recording medium and then changes the rotation speed of the roller base material so as to adjust the timing for forming the nip.

4. The image forming apparatus according to claim 1, wherein the control unit controls the roller driving unit when the concave portion faces the image carrier so as to adjust a rotational position of the transfer roller, and on the other hand controls torque of the roller driving unit when the nip is formed.

5. The image forming apparatus according to claim 1, wherein the roller base material is rotatably driven according to moving of the image carrier while the nip is formed, and wherein the roller base material rotates by the roller driving unit while the concave portion faces the image carrier.

6. The forming apparatus according to claim 1, wherein the control unit controls the roller driving unit with a first gain while the concave portion faces the image carrier so as to adjust a rotational position of the transfer roller, and on the other hand controls the roller driving unit with a second gain smaller than the first gain while the nip is formed so as to adjust the rotational position of the transfer roller.

7. An image forming method comprising the steps of:

rotating a transfer roller while contacting with an image carrier that moves at a predetermined speed while carrying an image;

gripping a recording medium by a grip unit that is disposed in a concave portion while the concave portion provided on a peripheral surface of a roller base material of the transfer roller faces the image carrier;

detecting a rotation phase of the transfer roller using a sensor;

adjusting a timing for forming the nip based on the rotation phase detected by the sensor; and transferring the image carried on the image carrier onto the recording medium by passing the recording medium through a nip while an elastic layer disposed on a peripheral surface of the roller base material of the transfer roller contacts with the image carrier so as to form the nip between the image carrier and the elastic layer.

* * * * *